US007038648B2

(12) United States Patent
Yamakawa et al.

(10) Patent No.: US 7,038,648 B2
(45) Date of Patent: May 2, 2006

(54) METHOD AND A DEVICE FOR DRIVING A LIQUID CRYSTAL DISPLAY, AND A LIQUID CRYSTAL DISPLAY APPARATUS

(75) Inventors: Eiji Yamakawa, Sanda (JP); Naoki Masazumi, Kobe (JP)

(73) Assignee: Minolta Co., Ltd., Osaka (JP)

( * ) Notice: Subject to any disclaimer, the term of this patent is extended or adjusted under 35 U.S.C. 154(b) by 274 days.

(21) Appl. No.: 10/304,887

(22) Filed: Nov. 26, 2002

(65) Prior Publication Data

US 2003/0103026 A1 Jun. 5, 2003

(30) Foreign Application Priority Data

Nov. 30, 2001 (JP) ..... 2001-367963
Feb. 18, 2002 (JP) ..... 2002-040853

(51) Int. Cl.
*G09G 3/36* (2006.01)

(52) U.S. Cl. ..... 345/90; 345/58; 345/87; 345/101

(58) Field of Classification Search ..... 345/58, 345/87, 101, 90
See application file for complete search history.

(56) References Cited

U.S. PATENT DOCUMENTS

| | | | | |
|---|---|---|---|---|
| 4,902,107 | A * | 2/1990 | Tsuboyama et al. | 349/72 |
| 5,345,250 | A * | 9/1994 | Inoue et al. | 345/100 |
| 5,675,351 | A * | 10/1997 | Kaneko et al. | 345/87 |
| 5,684,503 | A | 11/1997 | Nomura et al. | 345/97 |
| 5,748,277 | A | 5/1998 | Huang et al. | 349/169 |
| 5,751,382 | A * | 5/1998 | Yamada et al. | 349/12 |
| 6,075,511 | A * | 6/2000 | Iwasaki et al. | 345/101 |
| 2002/0039088 | A1 * | 4/2002 | Schlangen et al. | 345/87 |

FOREIGN PATENT DOCUMENTS

| | | | |
|---|---|---|---|
| JP | 2001-228459 | A | 8/2001 |
| JP | 2002-014323 | A | 1/2002 |
| WO | WO 98/50804 | A2 | 11/1998 |

* cited by examiner

*Primary Examiner*—Sumati Lefkowitz
*Assistant Examiner*—Alexander S. Beck
(74) *Attorney, Agent, or Firm*—Sidley Austin LLP

(57) ABSTRACT

Disclosed herewith is a matrix driving method of liquid crystal which exhibits a cholesteric phase. In the method, there is a selection pulse application step of applying pulses to select the final state of the liquid crystal, and between the selection pulse application step of a scanning line and the selection pulse application step of the next scanned scanning line, a delay step is inserted. During the delay step, a signal pulse is of 0V or of a pulse voltage for a display of a specified density.

30 Claims, 16 Drawing Sheets

DRIVING EXAMPLE 1 (2-1 DELAY)

TEMPERATURE CHARACTERISTIC OF POWER CONSUMPTION

DRIVING EXAMPLE 2 (2-1 DELAY)

DRIVING EXAMPLE 3 (1-2 DELAY)

COMPARATIVE EXAMPLE 1 (NO DELAYS)

COMPARATIVE EXAMPLE 2 (NO DELAYS)

METHOD AND A DEVICE FOR DRIVING A LIQUID CRYSTAL DISPLAY, AND A LIQUID CRYSTAL DISPLAY APPARATUS

This application is based on Japanese patent application Nos. 2001-367963 and 2002-40853, the contents of which are herein incorporated by reference.

BACKGROUND OF THE INVENTION

1. Field of the Invention

The present invention relates to a method and a device for driving a liquid crystal display and a liquid crystal display apparatus, and more particularly to a method and a device for driving a liquid crystal display by applying pulse driving voltages to liquid crystal through a plurality of scanning electrodes and a plurality of signal electrodes which cross each other at a right angle and a liquid crystal display apparatus.

2. Description of Related Art

In recent years, as media for reproducing digital information as visual information, reflective type liquid crystal displays which use liquid crystal which exhibits a cholesteric phase at room temperature (typically, chiral nematic liquid crystal) have been studied and developed into various kinds because such liquid crystal displays have the advantages of consuming little electric power and of being produced at low cost. Such liquid crystal displays which use liquid crystal with a memory effect, however, have the disadvantage of having a low driving speed.

In order to write an image on such a liquid crystal display, a method which comprises a reset step for resetting the liquid crystal to an initial state, a selection step for selecting the final state of the liquid crystal, an evolution step for causing the liquid crystal to evolve to the state selected in the selection step and a display step for displaying an image has been suggested.

Incidentally, the response speed of chiral nematic liquid crystal to a voltage applied thereto increases as the circumstantial temperature is rising. Accordingly, as the circumstantial temperature is rising, the frequency of driving pulses must be heightened by altering a basic clock. There is, however, a problem that as the frequency of driving pulses becomes higher, the consumption of electric power becomes larger.

SUMMARY OF THE INVENTION

An object of the present invention is to provide a method and a device for driving a liquid crystal display and a liquid crystal display apparatus which suppress an increase in power consumption with a rise in temperature to permit usage of a battery with a small power supply.

In order to attain the object, a first aspect of the invention relates to a method for driving a liquid crystal display which comprises liquid crystal which exhibits a cholesteric phase at room temperature, a plurality of scanning electrodes and a plurality of signal electrodes which face and cross each other with the liquid crystal in-between and which makes a display by using selective reflection of the liquid crystal in a cholesteric phase. In the method, in scanning of at least one set of scanning electrodes which are to be serially scanned, a delay step is inserted between a selection pulse application step of a previously scanned scanning electrode and a selection pulse application step of a later scanned scanning electrode.

A second aspect of the invention relates to a liquid crystal display apparatus which comprises a liquid crystal display which comprises liquid crystal which exhibits a cholesteric phase at room temperature, a plurality of scanning electrodes and a plurality of signal electrodes which face and cross each other with the liquid crystal in-between and which makes a display by using selective reflection of the liquid crystal in a cholesteric phase, and a driving circuit for the liquid crystal display. In the apparatus, a scanning electrode driver of the driving circuit sends a selection signal which comprises a chain of pulses to generate reset pulses, selection pulses and evolution pulses and inserts a delay step between a selection pulse application step of a previously scanned scanning electrode and a selection pulse application step of a later scanned scanning electrode in scanning of at least one set of scanning electrodes which are to be serially scanned.

A third aspect of the invention relates to a device for driving a liquid crystal display which comprises liquid crystal which exhibits a cholesteric phase at room temperature, a plurality of scanning electrodes and a plurality of signal electrodes which face and cross each other with the liquid crystal in-between and which makes a display by using selective reflection of the liquid crystal in a cholesteric phase. In the device, a scanning electrode driver sends a selection signal which comprises a chain of pulses to generate reset pulses, selection pulses and evolution pulses and inserts a delay step between a selection pulse application step of a previously scanned scanning electrode and a selection pulse application step of a later scanned scanning electrode in scanning of at least one set of scanning electrodes which are to be serially scanned.

According to the first, second and third aspects of the invention, a delayed scanning mode is adopted. In the delayed scanning mode, in scanning of at least one set of scanning electrodes which are to be serially scanned, a delay step is inserted between a selection pulse application step of a previously scanned scanning electrode and a selection pulse application step of a later scanned scanning electrode is adopted. Thereby, the frequency of driving pulses can be lowered. Specifically, even if the circumstantial temperature rises, the frequency of driving pulses can be inhibited from becoming high, thereby preventing an increase in power consumption. When a delay step is inserted, the writing speed in a high temperature range is reduced a little but is not lower than the writing speed in a low temperature range.

If at least one selected from a group consisting of whether or not the delay step should be inserted, the length of the delay step, the frequency of the delay step is a setting condition of the delay step, the writing speed and the frequency of driving pulses can be adjusted in accordance with the circumstances. Preferably, the setting conditions of the delay step are determined in accordance with circumstantial temperature of the liquid crystal display. As the setting conditions of the delay step, more specifically, insertion or omission of the delay step (whether or not the delay step is inserted), the length of the delay step, the frequency of the delay step (in how many scanning lines one delay step is inserted or how many delay steps are inserted in every scanning line) and the circumstantial temperatures at which these conditions should be changed can be named.

According to the first, second and third aspects of the invention, the data signals applied to the signal electrodes are variable within a range under a threshold voltage to change the state of the liquid crystal. Therefore, although the signal pulses applied to the pixels on a selected scanning electrode indispensably influence the other pixels on the other scanning electrodes, that is, crosstalk indispensably occurs, by inserting a delay step, the occurrence of crosstalk can be avoided in at least part of image writing.

The data signals during the delay step may be 0V or may be a pulse voltage to cause the liquid crystal to display a specified density. By applying the pulse voltage for a display of the specified density during the delay step, density differences among the scanning electrodes can be eased.

The length of the delay step is preferably equal to or n times (n: positive integer) the length of the selection pulse application step. With this arrangement, it is only necessary to synchronize the times to transmit image data to the driver with the respective selection pulse application steps. Thus, the control is easy.

Further, the ratio of the length of the selection step to the length of the selection pulse application step may be changed in accordance with circumstantial temperature of the liquid crystal display. Thereby, drives of the liquid crystal display which are adapted to the response speed of the liquid crystal, which changes in accordance with circumstantial temperature, become possible. In this case, for easy control, it is preferred that a plurality of temperature ranges which determine the ratio of the length of the selection step to the length of the selection pulse application step are predetermined. Further, the border temperatures at which the ratio of the length of the selection step to the length of the selection pulse application step is changed may be set different between rises in temperature and drops in temperature, which brings an advantage that the number of switches of writing speed becomes less.

According to the first, second and third aspects of the invention, a step of applying driving voltages to the liquid crystal comprises a reset step of applying reset pulses to reset the liquid crystal to a homeotropic state, a selection step including a selection pulse application step of applying selection pulses to select the final state of the liquid crystal and an evolution step of applying evolution pulses to cause the liquid crystal to evolve to the state selected in the selection step. In this case, by setting the length of the delay step longer than the length of a pre-selection step between the reset step and the selection pulse application step and than the length of a post-selection step between the selection pulse application step and the evolution step, crosstalk at least during the pre-selection step and the post-selection step can be avoided, and ghost can be prevented. When the length of the delay step, the length of the pre-selection step and the length of the post-selection step are respectively n times (n: positive integer) the length of the selection pulse application step, by setting the length of the delay step two or more times the length of the selection pulse application step, ghost can be prevented more effectively.

The first, second and third aspects of the invention are applicable not only to progressive scanning in which scanning lines are scanned one by one progressively but also to interlace scanning in which one frame is divided into a plurality of fields and scanning lines are scanned with some lines skipped. Interlace scanning has the advantage of inhibiting blackout phenomena (occurrences of black lines on the screen) during image writing, and further, by applying the present invention to the interlace scanning, occurrences of ghost due to crosstalk can be inhibited.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Embodiments of a method and a device for driving a liquid crystal display and a liquid crystal display apparatus according to the present invention will be described with reference to the accompanying drawings.

Liquid Crystal Display; See FIG. 1

First, a liquid crystal display which comprises liquid crystal exhibiting a cholesteric phase and which is driven by a method according to the present invention is described.

Figure 1:
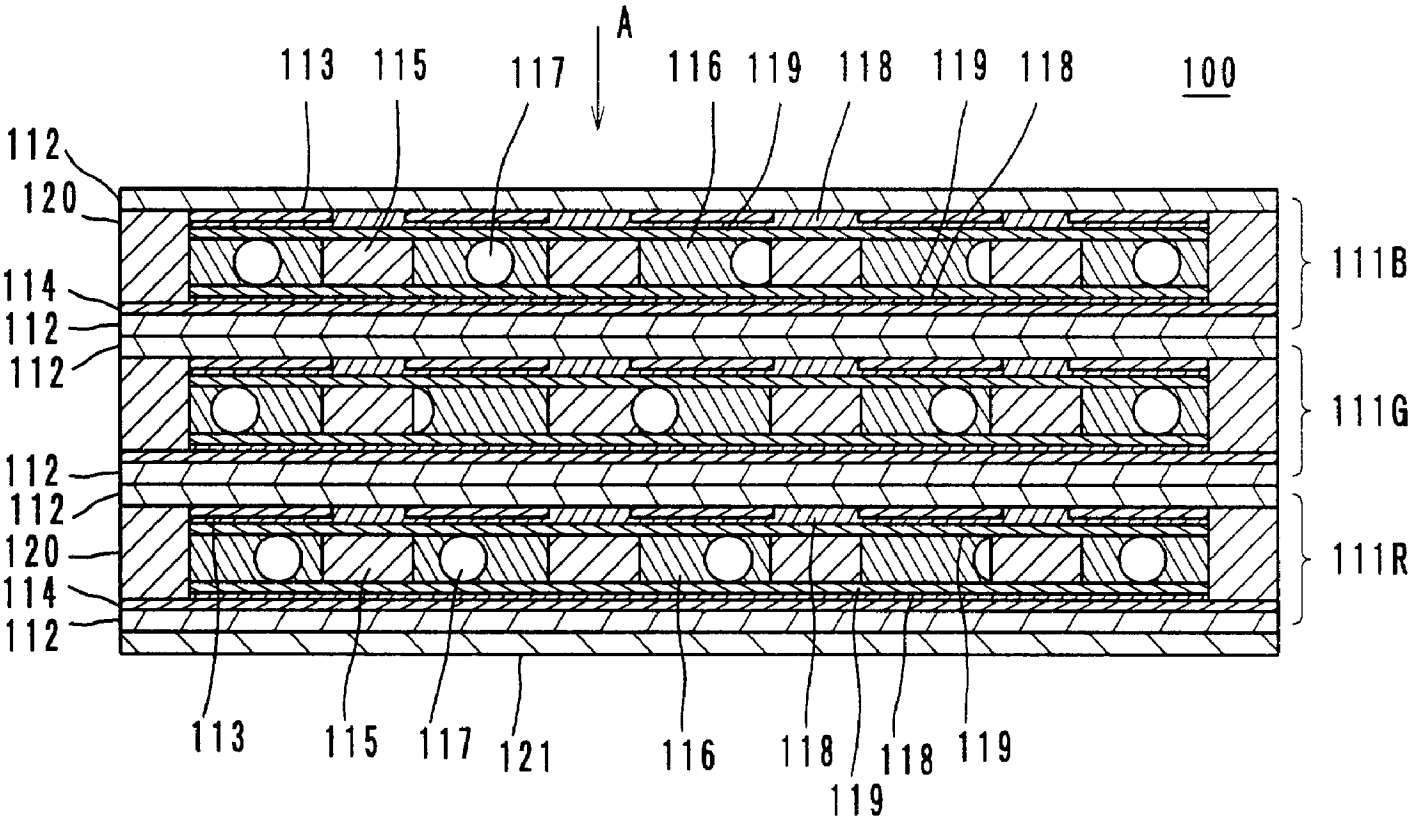
FIG. 1 is a sectional view of an exemplary liquid crystal display which is a component of a liquid crystal display apparatus according to the present invention.

FIG. 1 shows a reflective type liquid crystal display which is driven by a simple matrix driving method. This liquid crystal display 100 has, on a light absorbing layer 121, a red display layer 111R, a green display layer 111G and a blue display layer 111B which are stacked in this order. The red display layer 111R displays red by switching liquid crystal between a red selective reflection state and a transparent state. The green display layer 111G displays green by switching liquid crystal between a green selective reflection state and a transparent state. The blue display layer 111B displays blue by switching liquid crystal between a blue selective reflection state and a transparent state.

In each of the display layers 111R, 111G and 111B, resin nodules 115, liquid crystal 116 and spacers 117 are provided between transparent substrates 112 with transparent electrodes 113 and 114 formed thereon. On the transparent electrodes 113 and 114, an insulating layer 118 and an alignment controlling layer 119 are provided if necessary. Further, on the periphery of the substrates 112 (outside a display area), a sealant 120 is provided so as to seal the liquid crystal 116 between the substrates 112.

The transparent electrodes 113 and 114 are connected to driving ICs 131 and 132 (see FIG. 2) respectively, and specified voltages are applied to the transparent electrodes 113 and 114. In response to the voltages applied, the liquid crystal 116 switches between a transparent state of transmitting visible light and a selective reflection state of selectively reflecting visual light of a specified wavelength, and thereby, an image is displayed.

In each of the display layers 111R, 111G and 111B, the transparent electrodes 113 and 114 are each composed of a plurality of strip-like electrodes which extend in parallel to each other at fine intervals, and the extending direction of the electrodes 113 and the extending direction of the electrodes 114 are perpendicular to each other viewed from the top. Electric power is applied to these upper and lower electrodes one by one, and accordingly, electric power is applied to the liquid crystal 116 in a matrix way, so that an image is displayed on the liquid crystal 116. This is referred to as matrix driving, and the intersections between the electrodes 113 and 114 serve as pixels. By carrying out matrix driving in each of the display layers, a full color image can be displayed on the liquid crystal display 100.

A liquid crystal display which has liquid crystal which exhibits a cholesteric phase between two substrates makes a display by switching the liquid crystal between a planar state and a focal-conic state. When the liquid crystal is in a planar state, the liquid crystal selectively reflects light of a wavelength $\lambda=P\cdot n$ (P: helical pitch of the cholesteric liquid crystal, n: average refractive index of the liquid crystal). When the liquid crystal is in a focal-conic state, if the wavelength of light to be selectively reflected by the liquid crystal is within the infrared spectrum, the liquid crystal scatters incident light, and if the wavelength of light to be selectively reflected by the liquid crystal is shorter than the infrared spectrum, the liquid crystal scatters incident light very weakly and substantially transmits visible light. Accordingly, if the wavelength of light to be reflected by the liquid crystal is set within the visible spectrum and if a light absorbing layer is provided on the opposite side of the liquid crystal display to the observing side, when the liquid crystal is in a planar state, an observer can see a display of the color corresponding to the wavelength of light selectively reflected by the liquid crystal, and when the liquid crystal is in a focal-conic state, an observer can see a display of black. Also, if the wavelength of light to be reflected by the liquid crystal is set within the infrared spectrum and if a light absorbing layer is provided on the opposite side of the liquid crystal display to the observing side, when the liquid crystal is in a planar state, an observer can see a display of black because the liquid crystal reflects infrared light but transmits visible light, and when the liquid crystal is in a focal-conic state, an observer can see a display of white because the liquid crystal scatters light.

In the liquid crystal display 100 with the display layers 111R, 111G and 111B laminated, when the blue display layer 111B and the green display layer G are in a transparent state wherein the liquid crystal is in a focal-conic alignment and when the red display layer 111R is in a selective reflection state wherein the liquid crystal is in a planar alignment, a display of red is made. When the blue display layer 111B is in a transparent state wherein the liquid crystal is in a focal-conic alignment and when the green display layer 111G and the red display layer 111R are in a selective reflection state wherein the liquid crystal is in a planar alignment, a display of yellow is made. In such a way, by setting each of the display layers to a transparent state or a selective reflection state appropriately, displays of red, green, blue, white, cyan, magenta, yellow and black are possible. Further, by setting each of the display layers to an intermediate selective reflection state, display of intermediate colors are possible. Thus, the liquid crystal display 100 can be used as a full-color display.

As the liquid crystal 116, preferably, liquid crystal which exhibits a cholesteric phase at room temperature is used, and especially, chiral nematic liquid crystal which can be obtained by adding a sufficient amount of chiral agent to nematic liquid crystal is suited.

A chiral agent, when it is added to nematic liquid crystal, twists molecules of the nematic liquid crystal. When a chiral agent is added to nematic liquid crystal, liquid crystal molecules are formed into a helical structure with uniform twist intervals, and thereby, the liquid crystal exhibits a cholesteric phase.

The display layers are not necessarily to be of the above-described structure. The resin nodules may be walls or may be omitted. Also, each of the display layers may be structured into a polymer-dispersed liquid crystal composite layer in which liquid crystal is dispersed in a conventional three-dimensional polymer net or in which a three-dimensional polymer net is formed in liquid crystal.

Driving Circuit; See FIG. 2

Figure 2:
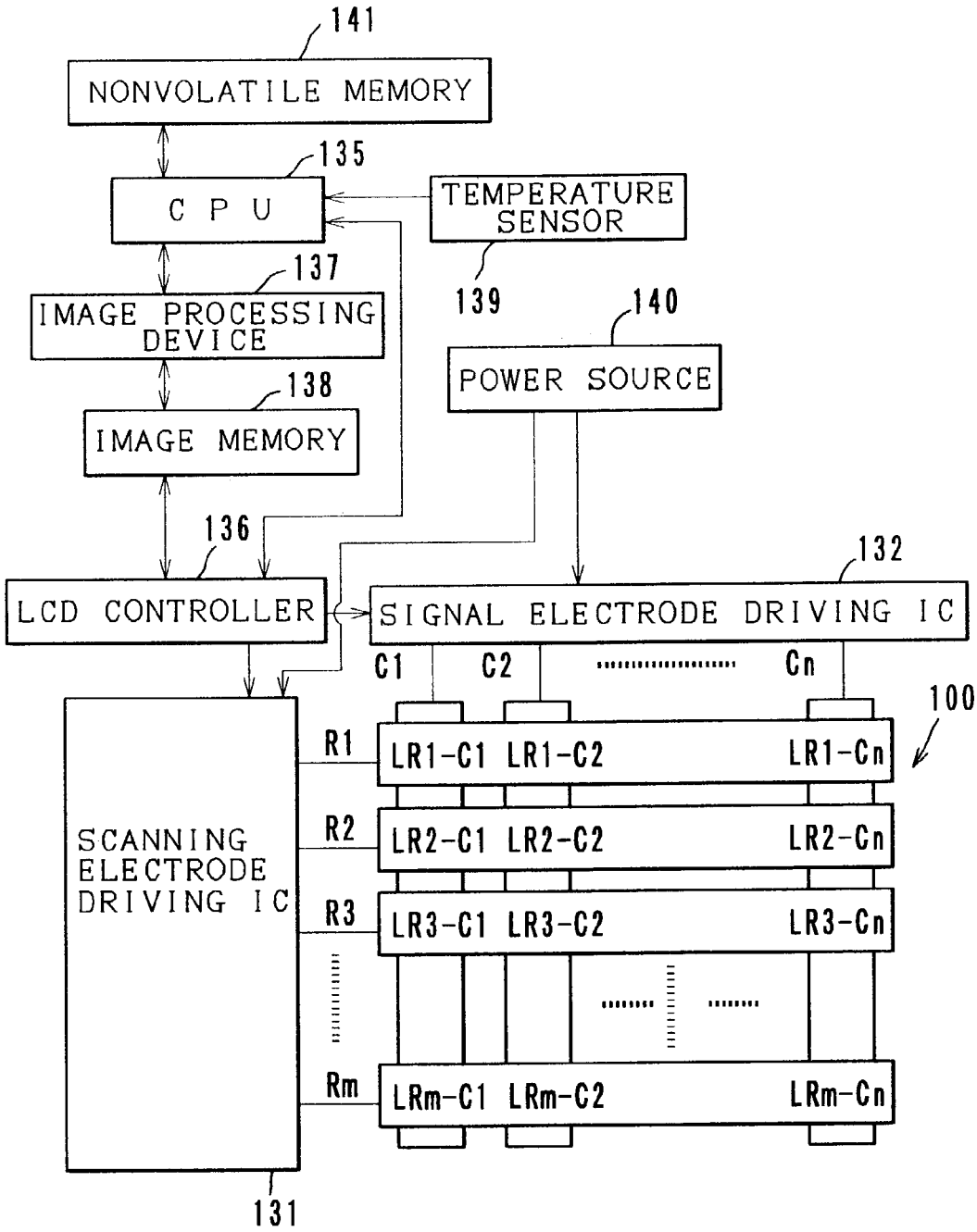
FIG. 2 is a block diagram which shows a control circuit of the liquid crystal display.

As FIG. 2 shows, the pixels of the liquid crystal display 100 is formed into a matrix which is composed of a plurality of scanning electrodes R1, R2 through Rm and a plurality of signal electrodes C1, C2 through Cn (m, n: natural numbers). The scanning electrodes R1, R2 through Rm are connected to output terminals of a scanning electrode driving IC 131, and the signal electrodes C1, C2 through Cn are connected to output terminals of a signal electrode driving IC 132.

The scanning electrode driving IC 131 sends a selection signal to a specified one of the scanning electrodes R1, R2 through Rm while sending non-selection signals to the other scanning electrodes. The scanning electrode driving IC 131 sends the selection signal to the scanning electrodes R1, R2 through Rm in order switching at uniform time intervals. In the meantime, the signal electrode driving IC 132 sends a signal in accordance with image data to all the signal electrodes C1, C2 through Cn simultaneously so as to carry out writing on the pixels in the scanning electrode in a selected state. For example, when a scanning electrode Ra (a: natural number, $a \leqq m$) is selected, writing is carried out simultaneously on the pixels Lra-C1 through Lra-Cn at the intersections between the scanning electrode Ra and the signal electrodes C1, C2 through Cn. At this time, in each of the pixels, the voltage difference between the scanning electrode and the signal electrode works as a writing voltage, and writing is carried out in each of the pixels in accordance with the writing voltage.

The driving circuit comprises a CPU 135, a LCD controller 136, an image processing device 137, an image memory 138, driving ICs (drivers) 131 and 132, and a nonvolatile memory 141. Electric power is supplied from a power source 140 to the driving ICs 131 and 132. The LCD controller 136 drives the driving ICs 131 and 132 in accordance with image data stored in the image memory 138, and the driving ICs 131 and 132 apply voltages to the scanning electrodes and the signal electrodes of the liquid crystal display 100 sequentially. Thereby, an image is written on the liquid crystal display 100. The CPU 135 takes in information about circumstantial temperature from a temperature sensor 139 which is provided near the liquid crystal display 100. The nonvolatile memory 141 is stored with information for determining the length of a selection pulse application step Tsp and the length of a selection step Ts, which will be described later. The liquid crystal display and the driving circuit compose a liquid crystal display apparatus. The details of the driving ICs 131 and 132 will be described later.

The driving ICs 131 and 132 are preferably provided for each of the display layers, that is, it is preferred that three sets of driving ICs 131 and 132 are provided. It is, however, possible that either the driving IC 131 or the driving IC 132 is shared with three display layers while the other IC is provided for each of the display layers. In the following, only one set of driving ICs 131 and 132 is described, but it is to be noted that the same driving method is adopted for each of the display layers.

For writing, all the scanning lines are selected in order. When the screen is to be partly renewed, the scanning lines in a specified area including the part to be renewed shall be selected in order. Thereby, writing on only the necessary part can be carried out for a short time.

Driving Principles and Basic Driving Example; See FIGS. 3 and 4

First, the principles of a method of driving the liquid crystal display 100 are described. Although in the following, the principles will be described in connection with an example wherein alternated pulse waves are used, it is to be noted that such alternated pulse waves are not necessarily used in the driving method.

Figure 3:
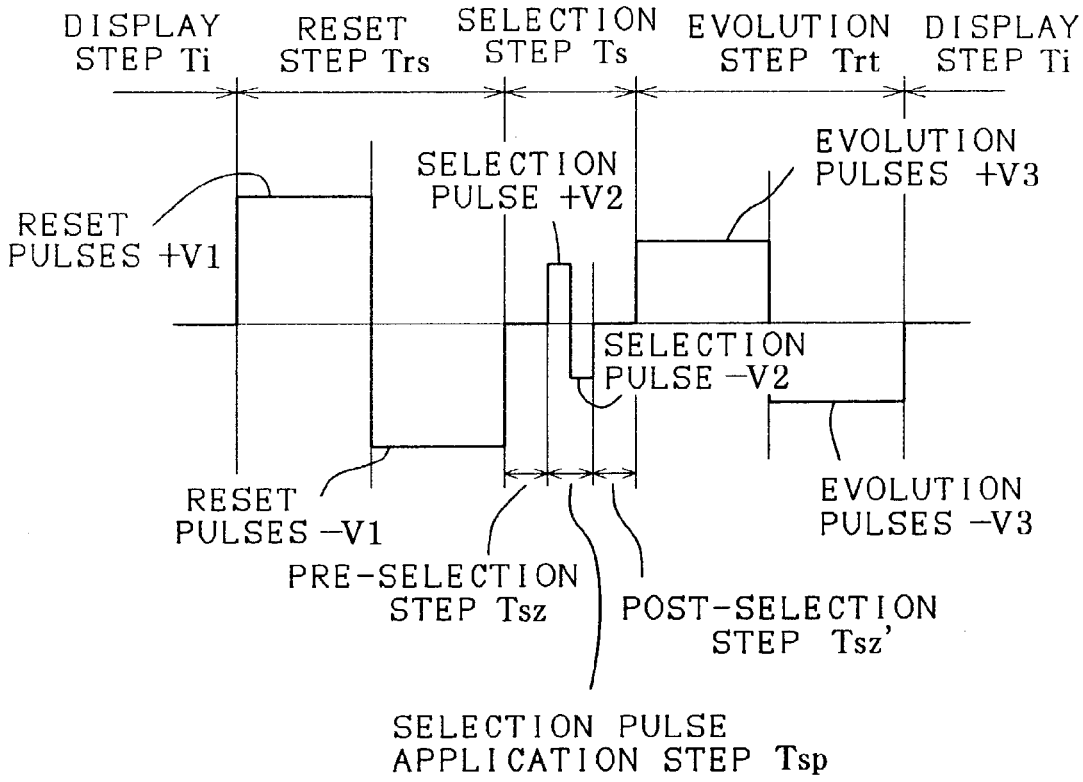
FIG. 3 is a chart which shows a basic driving wave used in a driving method according to the present invention.

FIG. 3 shows basic driving waves which are sent from the scanning electrode driving IC 131 to the respective scanning electrodes. This driving method generally comprises a reset step Trs, a selection step Ts, an evolution step Trt and a display step Ti (which is also referred to as crosstalk step). The selection step Ts is composed of a selection pulse application step Tsp, a pre-selection step Tsz and a post-selection step Tsz'.

Figure 4:
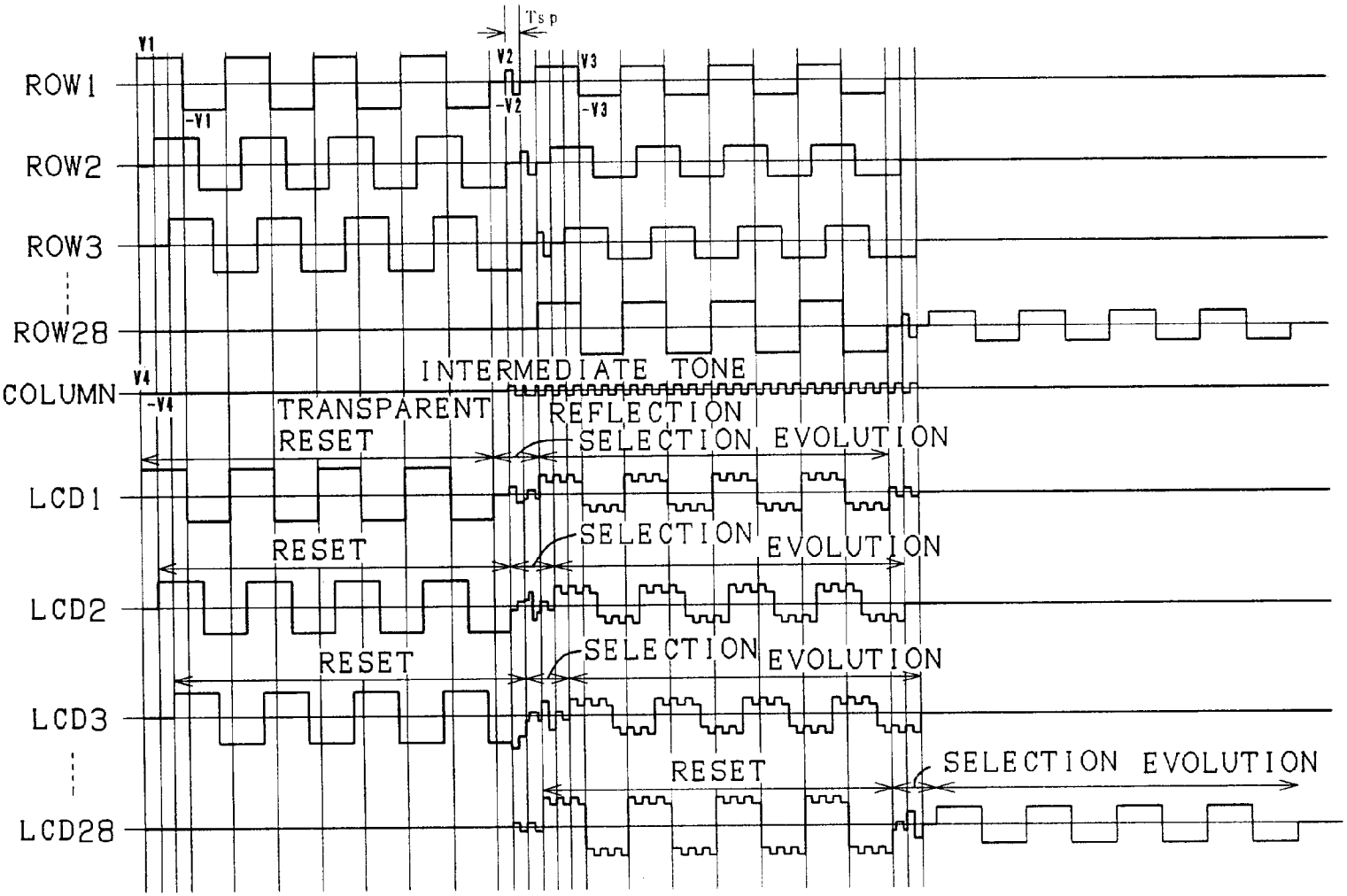
FIG. 4 is a chart which shows driving waves in a basic driving example which are applied to respective pixels.
Figure 5A:
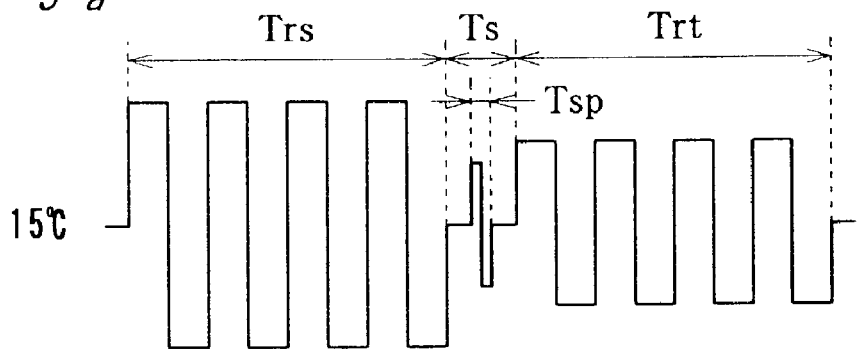
FIG. 5 is a chart which shows driving waves in the basic driving example which are outputted from a scanning electrode when the temperature changes.
Figure 5B:
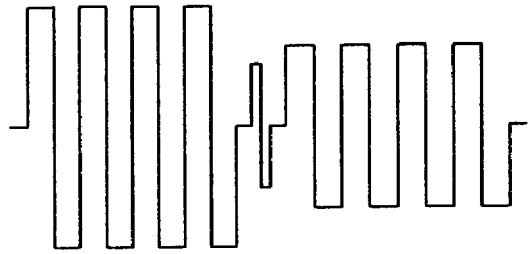
Figure 5C:
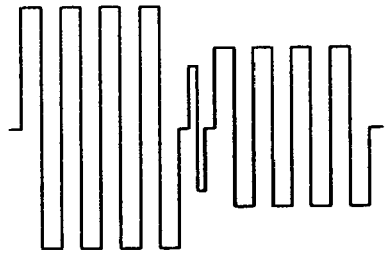
Figure 5D:
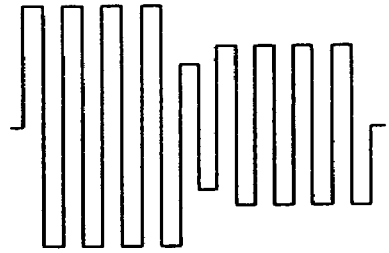
Figure 5E:
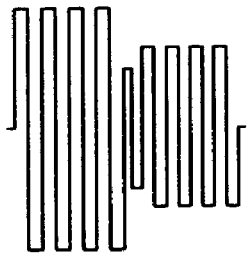

FIG. 4 shows a basic driving example in which a basic driving wave is applied to 28 scanning electrodes (ROW1, ROW2, ROW3 through ROW28) sequentially at uniform specified time lags and a signal wave is applied to one of the signal electrodes (COLUMN). In FIG. 4, the signal wave applied to the column is composed of a pulse to select a transmitting state, a pulse to an intermediate state and a pulse to select a complete reflection state which are arranged alternately in this order. The LCD1, LCD2, LCD3 through. LCD28 denote pixels at the intersections between the scanning electrodes and the signal electrode.

In the basic driving wave, in the reset step, reset pulses of ±V1 are applied to the scanning electrodes. In the selection pulse application step Tsp of the selection step Ts, selection pulses of ±V2 is applied to the scanning electrodes. Additionally, in the selection pulse application step Tsp, signal pulses of ±V4 are applied to the signal electrode from the signal electrode driving IC 132. The signal pulses of ±V4 are determined from image data. According to the basic driving wave, also, in the pre-selection step Tsz and the post-selection step Tsz', 0 volt is applied to the scanning electrodes. Then, in the evolution step, evolution pulses of ±V3 are applied to the scanning electrodes.

Next, the state of liquid crystal is described. First, when the reset pulses of ±V1 are applied in the reset step Trs, the liquid crystal reset to a homeotropic state. Thereafter, the liquid crystal comes to the selection pulse application step Tsp through the pre-selection step Tsz (where the liquid crystal is twisted a little). The waveform of the selection pulses applied in the step Tsp depends on whether the liquid crystal is to finally come to a planar state or a focal-conic state.

First, a case of selecting a planar state as the final state of the liquid crystal is described. In this case, in the selection pulse application step Tsp, selection pulses of ±(V2+V4) are applied to the liquid crystal so that the liquid crystal will come to a homeotropic state again. Thereafter, in the post-selection step Tsz', the liquid crystal is twisted a little. Then, in the evolution step Trt, the evolution pulses are applied to the liquid crystal, whereby the liquid crystal, which was twisted a little in the post-selection step Tsz', is untwisted and comes to a homeotropic state again.

The liquid crystal in a homeotorpic state comes to a planar state by application of 0 volt, and the liquid crystal stays in a planar state. In the display step Ti, crosstalk pulses of ±V4 are applied to the liquid crystal; however, since the voltage of the crosstalk pulses are smaller than the threshold value to change the state of the liquid crystal, the crosstalk pulses substantially do not influence the state of the liquid crystal.

On the other hand, in a case of selecting a focal-conic state as the final state of the liquid crystal, in the selection pulse application step Tsp, selection pulses of ±(V2−V4) are applied to the liquid crystal. Then, in the post-selection step Tsz', the liquid crystal is twisted and comes to a state where the helical pitch becomes approximately double.

Thereafter, in the evolution step Trt, the evolution pulses are applied. Thereby, the liquid crystal, which was twisted a little in the post-selection step Tsz', comes to a focal-conic state. The liquid crystal in a focal-conic state stays in the state even after the voltage applied thereto becomes zero. In the display step Ti, as in the case of selecting a planar state, crosstalk pulses of ±V4 are applied to the liquid crystal; however, the crosstalk pulses substantially do not influence the state of the liquid crystal.

As has been described, depending on the selection pulses applied to the liquid crystal in the selection pulse application step Tsp, the final state of the liquid crystal is determined. Also, by adjusting the voltage and the pulse width of the selection pulses, and more particularly by changing waveform of the pulses applied to the signal electrodes in accordance with image data, displays of intermediate tones are possible.

In the basic driving example shown by FIG. 4, scanning of each scanning electrode is carried out based on the length of the selection pulse application step Tsp, and on completion of the selection pulse application step of a scanning electrode, the selection pulse application step of the next scanning electrode starts.

Relationship between Temperature and Driving Frequency

Figure 6:
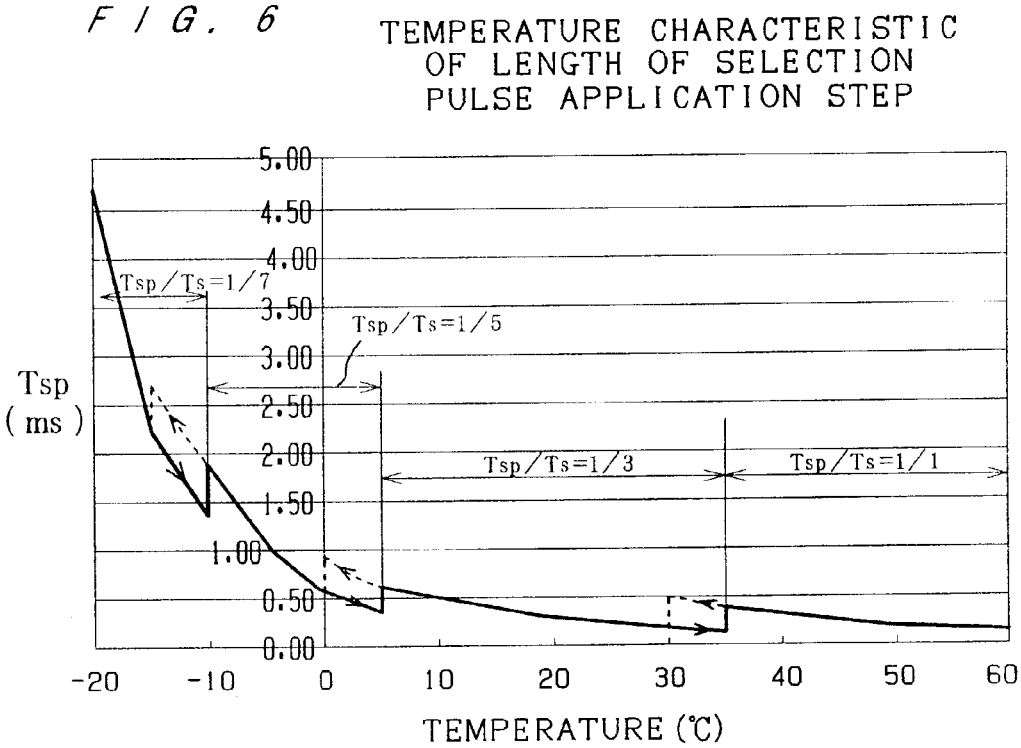
FIG. 6 is a graph which shows a temperature characteristic of the length of a selection pulse application step in the basic driving example.
Figure 7:
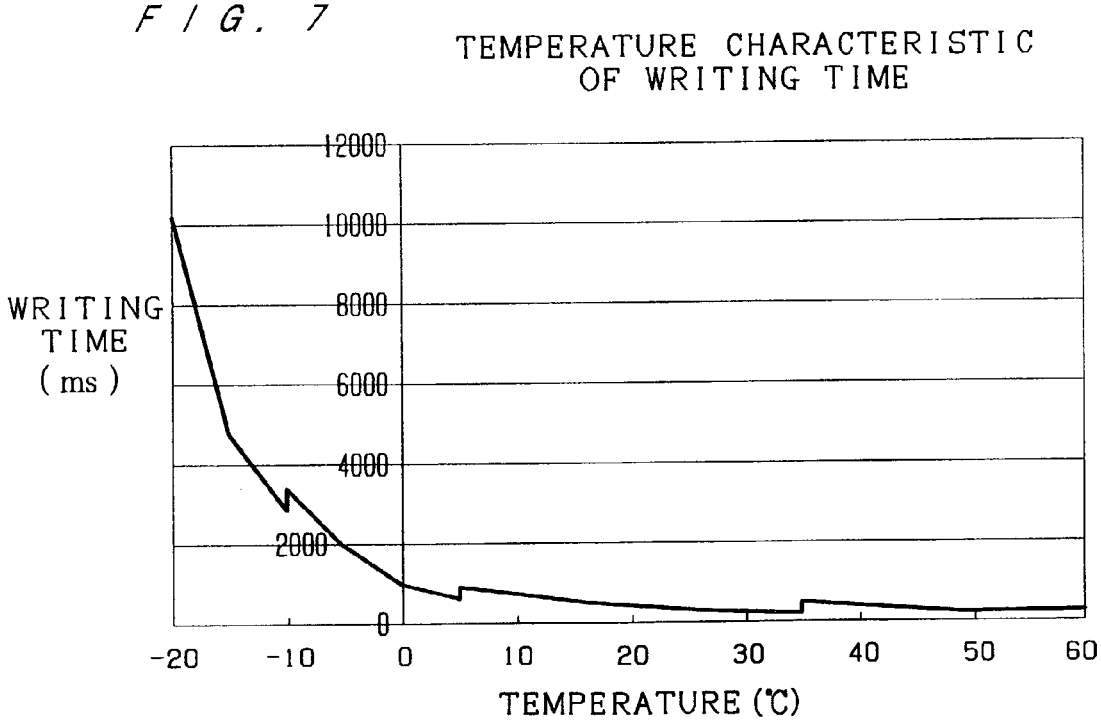
FIG. 7 is a graph which shows a temperature characteristic of a writing time in the basic driving example.

See FIGS. 5 through 7

As mentioned above, chiral nematic liquid crystal changes its response speed to driving voltages in accordance with temperature. More specifically, when temperature is low, chiral nematic liquid crystal has a low response speed to driving voltages, and when temperature is high, it has a high response speed to driving voltages. FIGS. 5*a* through 5*e* show basic driving waves in different temperature ranges. The response speed of liquid crystal to driving voltages becomes higher as temperature becomes higher. Therefore, the length of the selection pulse application step Tsp, which is the scanning time of one line, is set shorter as temperature becomes higher. Accordingly, the lengths of the reset step and the evolution step Trt are changed at the same rate. Such changes can be realized by changing the frequency of a basic clock generated by a basic clock generating means, which may be incorporated in the LCD controller 136 or the like, for example, by order of the CPU 135.

Under normal temperature, Tsp/Ts is ⅓; however, beyond a specified range, for example, beyond 35° C., Tsp/Ts is changed to 1/1. By changing Tsp/Ts in such a way, the driving frequency in a high temperature range can be inhibited from being too high. The setting of the rate Tsp/Ts in accordance with circumstantial temperature is determined by information stored in the memory 141. Specifically, the CPU 135 reads out the values Tsp and Ts which match the circumstantial temperature from the memory 141 and sends an appropriate command to the LCD controller 136.

FIG. 6 shows a temperature characteristic of the selection pulse application step Tsp within a range from −20° C. to 60° C. In this example, Tsp/Ts is set as follows: within a range from −20° C. to −10° C., Tsp/Ts=1/7; within a range from −10° C. to 5° C., Tsp/Ts=⅕; within a range from 5° C. to 35° C., Tsp/Ts=⅓; and within a range from 35° C. to 60° C., Tsp/Ts=1/1. With this setting, the following advantages can be obtained: in a low temperature range, the speed of image writing can be inhibited from becoming low; and in a high temperature range, the driving frequencies of the driving ICs 131 and 132 can be inhibited from becoming high.

As FIG. 6 shows, the temperature characteristic of the selection pulse application step Tsp when temperature is rising and that of the selection pulse application step Tsp when temperature is falling are different from each other. With this arrangement, the number of times of switching the driving speed is smaller. In FIG. 7 and the following figures, for simplification, only the temperature characteristic of the selection pulse application step Tsp when temperature is rising is shown. Further, the temperature characteristic of the selection pulse application step Tsp does not necessarily have a curve which changes intermittently at the borders among some temperature ranges and is not necessarily made a difference between a case where temperature is rising and a case where temperature is falling. It is possible to make a continuous temperature characteristic curve of the selection pulse application step Tsp in all the temperature ranges.

FIG. 7 shows the relationship between the time required for writing on a screen composed of 1024×768 pixels and temperature when the selection pulse application step Tsp has the temperature characteristic shown by FIG. 6. The time required for writing on the screen is calculated by the expression below. With changes in temperature, the length of the selection pulse application step Tsp is changed, and accordingly, the time for writing on the screen is changed.

Time for writing on a screen=length of reset step Trs+(length of selection pulse application step Tsp×number of scanning lines)+length of evolution step Trt In the above-described basic driving example, as temperature is rising, the driving frequency becomes higher, and accordingly the power consumption of the liquid crystal display apparatus becomes higher. In the basic example, the driving frequency is inhibited from becoming too high by changing Tsp/Ts; however, the power consumption can be reduced further.

Driving Example 1; See FIGS. 8 through 11

Now, a driving example 1 which adopts a delayed scanning method while being based on the basic scanning example is described. In the driving example 1, the power consumption in a high temperature range can be further inhibited.

Figure 8:
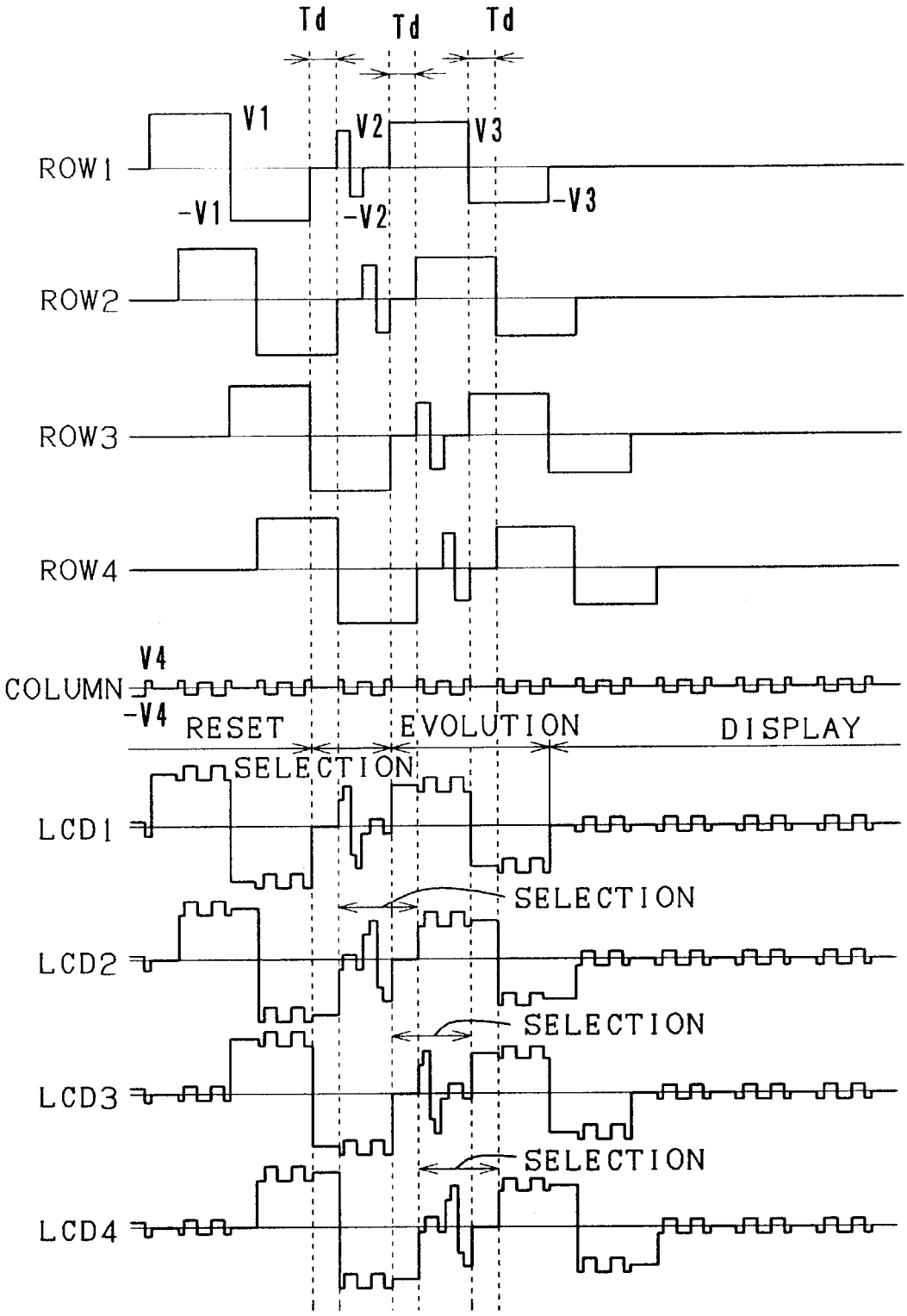
FIG. 8 is a chart which shows driving waves in a first driving example which are applied to respective pixels.

In FIG. 8, basic driving waves which are applied to respective scanning electrodes (ROW1 through ROW4) and a signal wave which is applied to a signal electrode (COLUMN) are shown. Also, pulse waves which act on respective pixels (LCD1 through LCD4) are shown.

The driving example 1 is to drive liquid crystal under the same principle as the basic driving example. What is different from the basic driving example is to insert a delay step Td every after two selection steps Ts. The delay step Td is to delay the time to apply pulses to a scanning electrode by a time of one unit which is equal to the length of the selection pulse application step, and in synchronization with this delay, the time to apply pulses to a signal electrode is delayed. The delay of pulse applications can be realized by keeping both the potential of the scanning electrode and the potential of the signal electrode to be 0 volt. In the driving example 1, it is determined from the circumstantial temperature whether such delay steps Td are inserted. The border temperature at which delay steps Td are inserted or omitted is stored in the nonvolatile memory 141 beforehand. During the delay step Td, the signal wave applied to the COLUMN is kept 0V. In the following, this driving method is referred to as a 2-1 delay mode, and the basic driving example (with no delay steps Td) is referred to as a continuous scanning mode.

Figure 9:
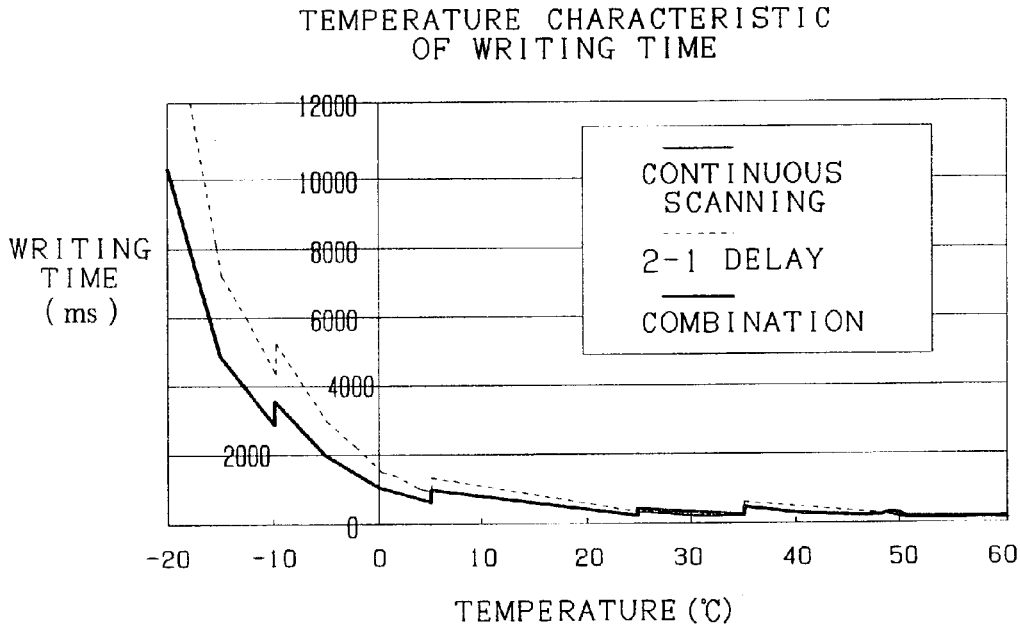
FIG. 9 is a graph which shows a temperature characteristic of a writing time in the first driving example.
Figure 10:
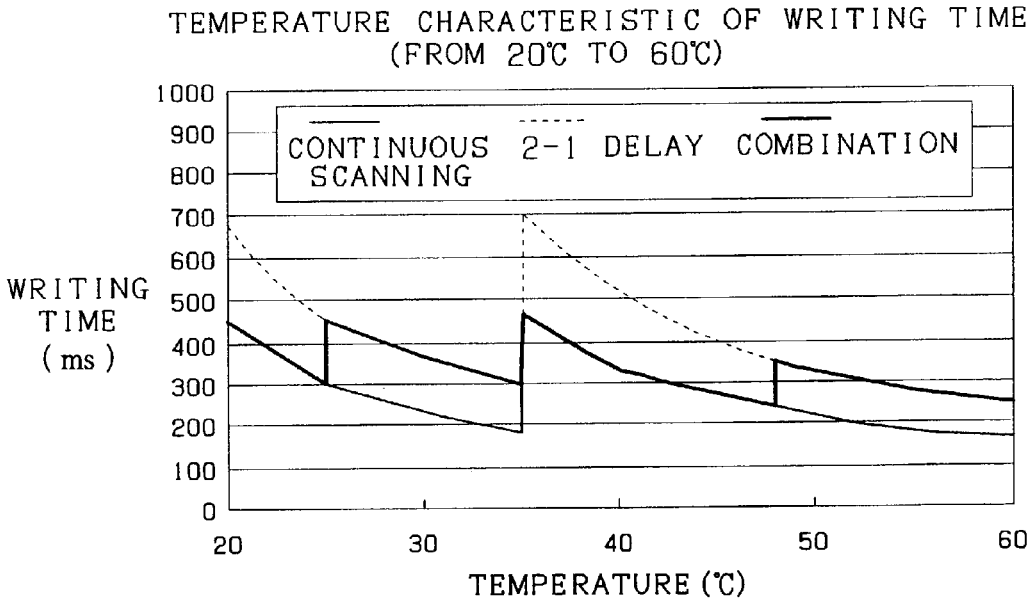
FIG. 10 is a graph which shows the temperature characteristic of a writing time in the first driving example in details.

FIG. 9 shows temperature characteristics of writing time, and FIG. 10 shows the characteristics within a range from 20° C. to 60° C. in more detail. In FIGS. 9 and 10, temperature characteristics of writing time in the continuous scanning mode, in the 2-1 delay mode and in a combination of these two modes are shown. The writing time in the 2-1 delay mode is ⅔ of the writing time in the continuous scanning mode. Therefore, in order to shorten the writing time as well as to reduce the power consumption, these two modes should be combined to have their respective advantages. Specifically, within a range from −20° C. to 25° C., the continuous scanning mode is adopted; within a range from 25° C. to 35° C., the 2-1 delay mode is adopted; within a range from 35° C. to 50° C., the continuous scanning mode is adopted again; and within a range from 50° C. to 60° C., the 2-1 delay mode is adopted again.

Figure 11:
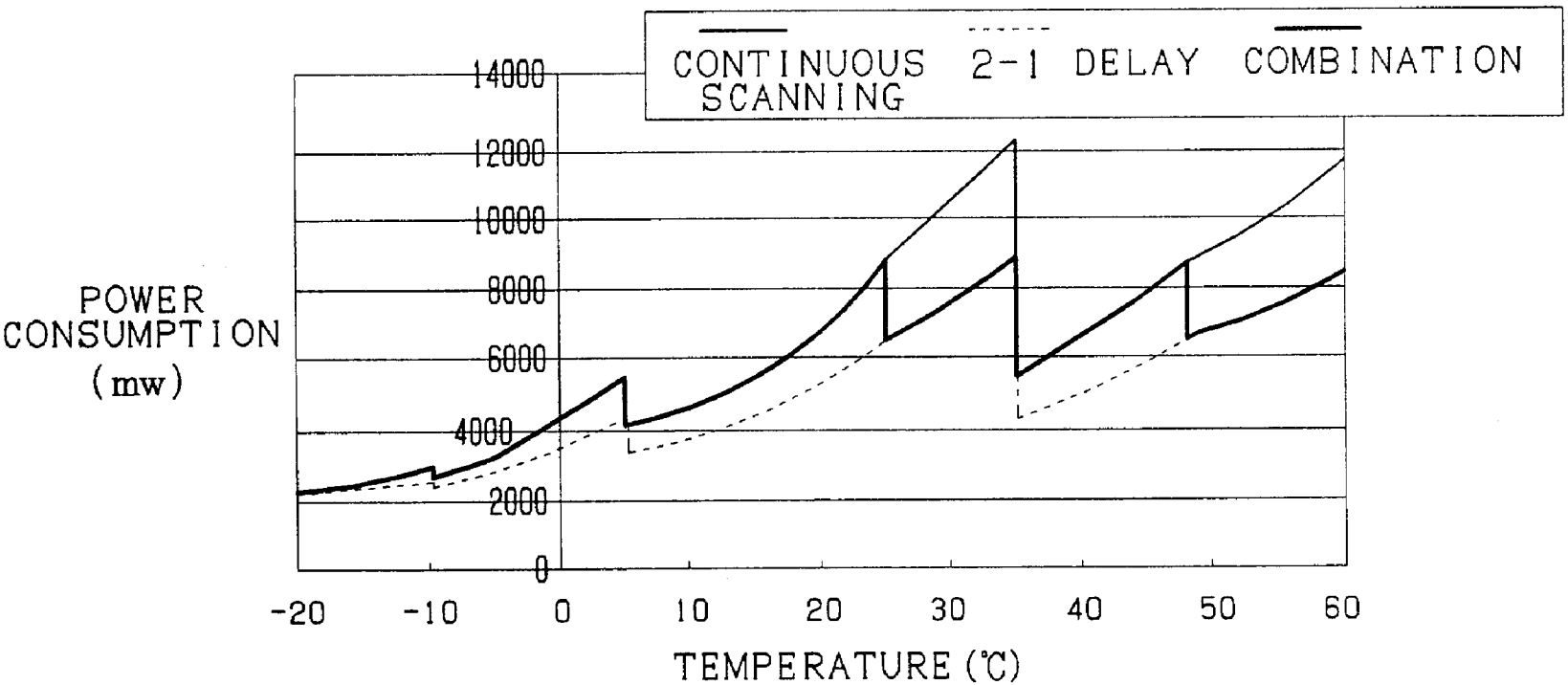
FIG. 11 is a graph which shows a temperature characteristic of a power consumption in the first driving example.

FIG. 11 shows temperature characteristics of power consumption. The temperature characteristics here are the relationship between power consumption and temperature in cases of driving a liquid crystal display apparatus with the following specs in the continuous scanning mode, in the 2-1 delay mode and in the combination mode. The power consumption includes the power consumption of the driving ICs 131 and 132 and the power consumption of the LCD controller 136.

number of rows: 1024
number of columns: 768
height of screen: 138.3 mm
width of screen: 103.8 mm
diagonal dimension: 6.8 inches
volume of liquid crystal: 3200 pF/cm$^2$ reset voltage: ±30V
selection voltage: ±15V
evolution voltage: ±21V
column voltage: ±4.5V As is apparent from FIG. 11, when the continuous scanning mode is adopted, the liquid crystal display apparatus consumes more than 10 W around a temperature range from 30° C. to 35° C. and beyond 50° C. However, when the 2-1 delay mode is combined, the power consumption of the liquid crystal display apparatus around these temperature ranges can be reduced to an extent of around 8 W.

More specifically, when temperature rises, delay steps are inserted so as to lower the driving frequency, and thereby the power consumption can be inhibited from being higher. The length of the delay steps can be set arbitrarily within a range as long as it results in only a permissible reduction in writing speed. Further, it is not always necessary to insert such a delay step every two selection pulse application step, and the rate of insertion of a delay step can be set arbitrarily. Such a delay step may be inserted after every selection pulse application step and may be inserted after every three or more selection pulse application steps. If it is desired to renew the screen within tens of seconds, at room temperature, preferably at the most around 50 delay steps shall be inserted.

The length of the delay step is preferably equal to or a multiple of the length of the selection pulse application step. With this arrangement, the controller 136 shown in FIG. 2 can synchronize the time to send image data to the driving ICs 131 and 132 with each selection pulse application step.

Driving Example 2; See FIG. 12

Figure 12:
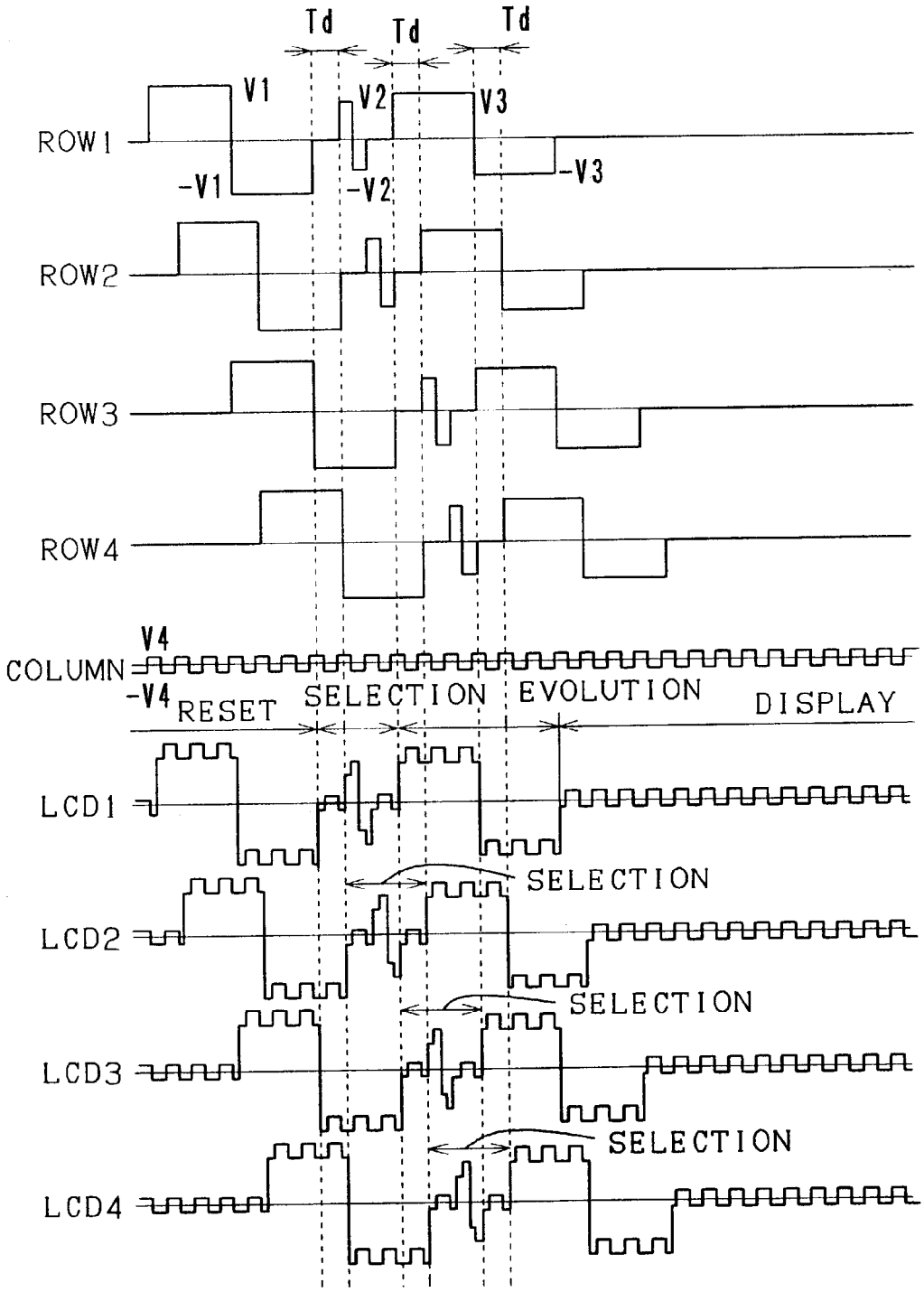
FIG. 12 is a chart which shows driving waves in a second driving example which are applied to respective pixels.

Next, driving example 2 which adopts the delayed scanning mode is described referring to FIG. 12. The pulse waves shown in FIG. 12 indicate the same things as those in FIG. 8.

Like the driving example 1, the driving example 2 is to inhibit the power consumption from being high in a high temperature range while being based on the basic driving example. What is different from the driving example 1 is that the column signal during each delay step Td is set to a pulse voltage for a display of a specified intermediate tone. There are essentially no image data in the delay steps; however, by applying a pulse voltage for a display of a specified gray level during each delay step, density differences among scanning lines can be inhibited. In this case, the strength of crosstalk becomes even without regard to the positions of the scanning lines.

Driving Example 3; See FIG. 13

Figure 13:
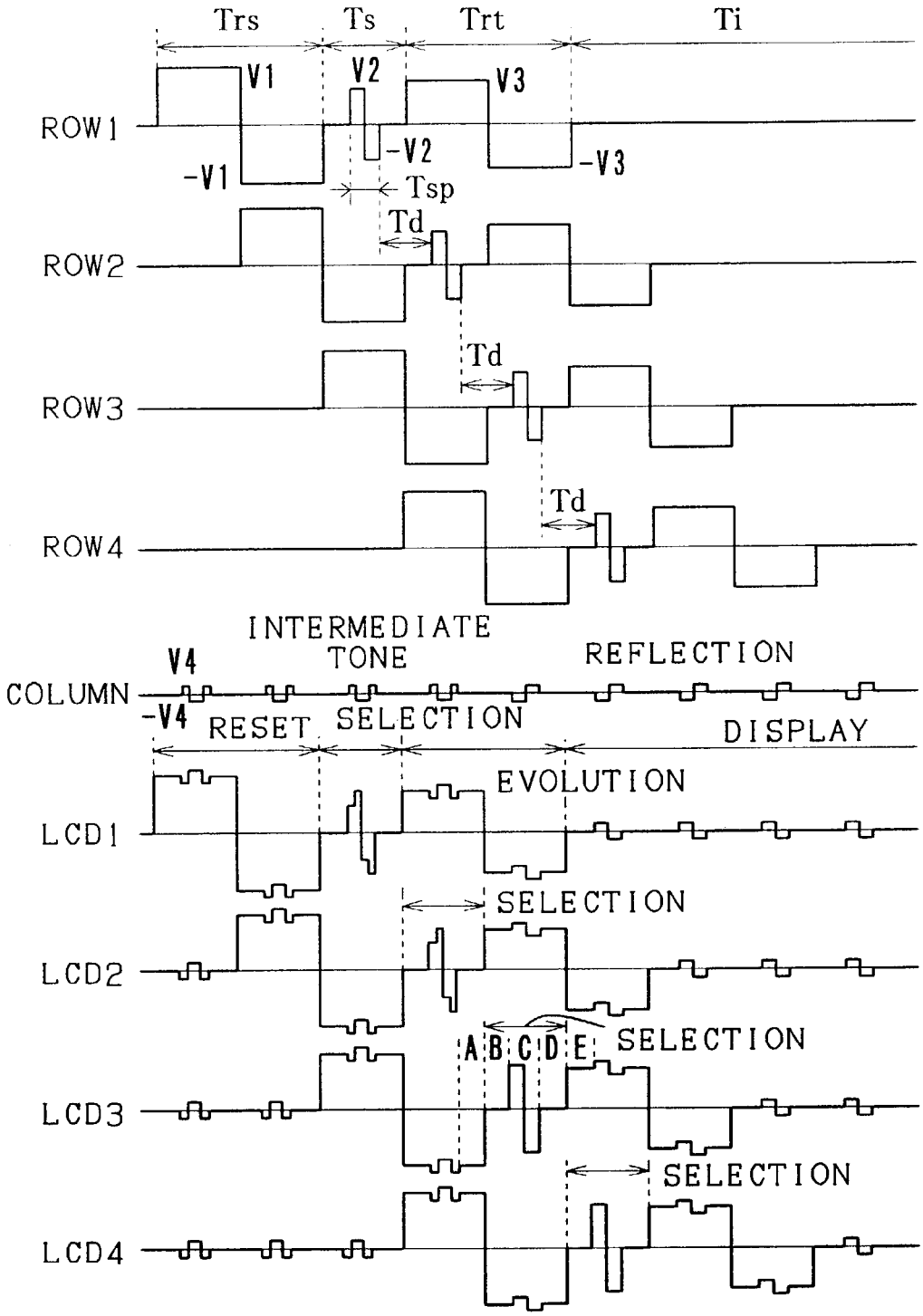
FIG. 13 is a chart which shows driving waves in a third driving example which are applied to respective pixels.

Next, driving example 3 which adopts the delayed scanning mode is described referring to FIG. 13. The pulse waves shown in FIG. 13 indicate the same things as those in FIG. 8.

Like the driving example 1, the driving example 3 is based on the basic driving example and is to inhibit the power consumption from being higher in a high temperature range. Another purpose of the driving example 3 is to avoid occurrences of ghost in the pixels on non-selected scanning lines. What is different from the driving example 1 is to delay the selection pulse application step of every scanning line by a time of two units (Tsp×2). Therefore, this driving example 3 is referred to as a 1-2 delay mode. In this example 3, Tsp/Ts=⅓. As is apparent from FIG. 13, the voltage applied to the signal electrode becomes an alternated pulse voltage only during the selection pulse application step and is kept 0 volt during the other steps.

FIG. 13 shows a case of writing intermediate tones in LCD1 and LCD2 and writing the densest image (reflection) in LCD3 and LCD4. For example, the length of the reset step Trs and the length of the evolution step Trt are both 48 ms, and the length of the selection step Ts is 0.6 ms (the pre-selection step=0.2 ms, the selection pulse application step=0.2 ms, the post-selection step=0.2 ms). In this case, the time required for scanning one line is 0.2 ms.

Focusing on the pixel LCD3, in the driving example 3, crosstalk does not occur in a duration A which is the last part of the reset step, in the pre-selection step B, in the post-selection step D and in a duration E which is the beginning part of the evolution step. From the studies made by the present inventors, it has been found out that if crosstalk occurs during these steps A, B, D and E, the final density of the pixel is influenced by the density of the image to be written in the renewing area, thereby causing ghost. In the last part of the reset step and in the beginning part of the evolution step, the influence of crosstalk is strong, and further, in the pre-selection step and in the post-selection step, the influence of crosstalk is stronger than that in the reset step and in the evolution step. In the driving example 3, the selection pulse application step Tsp of every scanning line is delayed by a time of two units, and thereby, application of crosstalk pulses to every scanning line can be avoided during the steps A, B, D and E. Consequently, occurrences of ghost due to crosstalk in the steps A, B, D and E can be prevented.

Like the driving example 1, the driving example 3 can be combined with the continuous scanning mode. The continuous scanning mode or the delayed scanning mode may be adopted depending on temperature.

Figure 14:
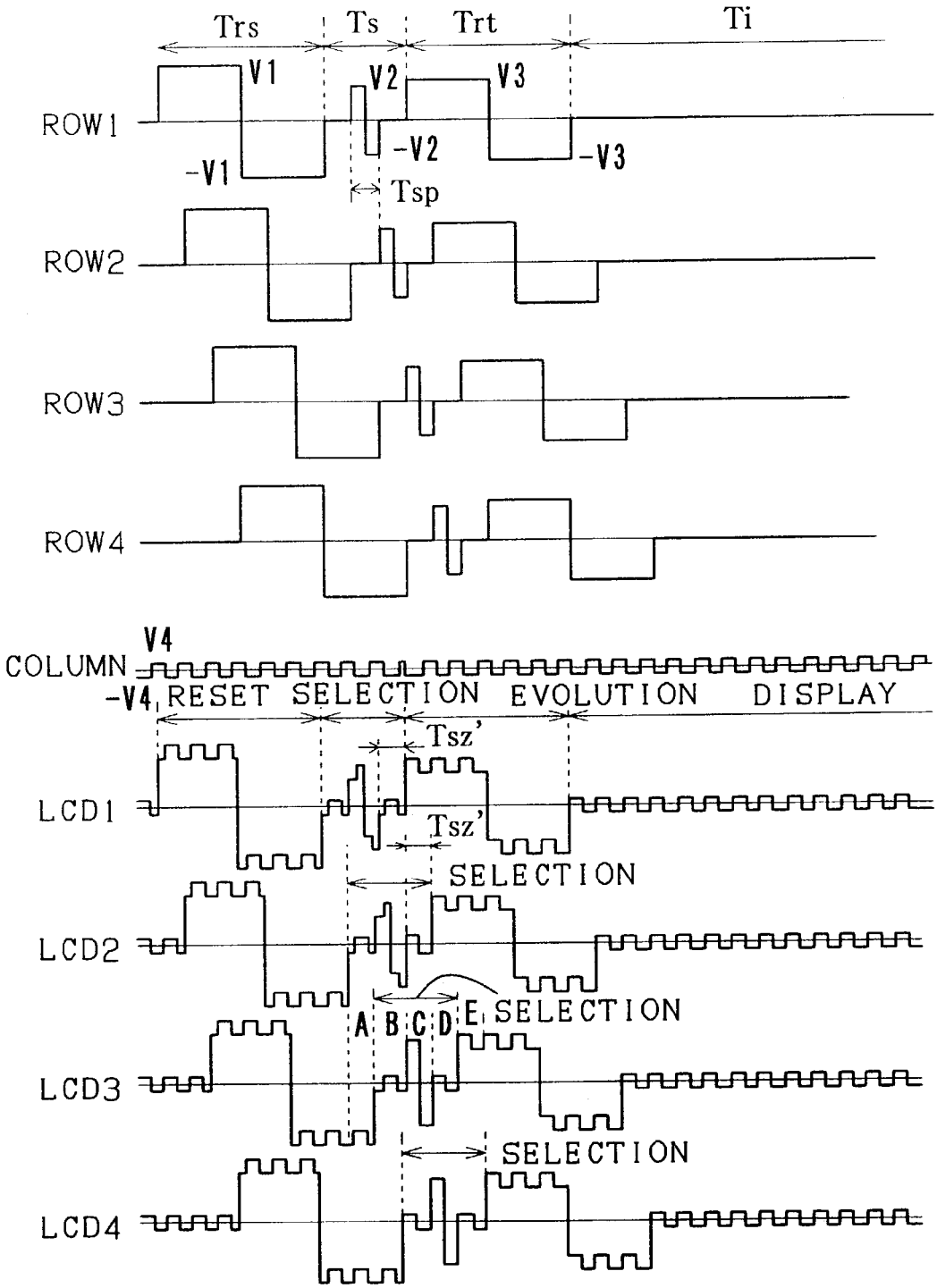
FIG. 14 is a chart which shows driving waves in a first comparative example which are applied to respective pixels.

FIG. 14 shows a comparative example 1 in which the same driving waves used in the driving example 3 are applied without inserting delay steps. In the comparative example 1, there are no delay steps, and crosstalk occurs during the steps A, B, D and E. Focusing on the respective post-selection steps Tsz' of LCD1 and LCD2 in which intermediate tones are to be written, the waves in the comparative example 1 are different from the waves in the driving example 3, and this difference causes ghost.

Driving Example 4; See FIG. 15

The driving example 4 has the same purposes as the driving example 3, and additionally, the driving example 4 is to shorten the scanning time. What is different from the driving example 3 is to delay the selection pulse application step of every scanning line by a time of three units (Tsp×3). Therefore, this is referred to as a 1-3 delay mode. In the driving example 3, Tsp/Ts=⅕. The time required for scanning one frame in this example 4 is 9/10 of that in the driving example 3. In this driving example 4 also, the voltage applied to the signal electrode becomes an alternated pulse voltage only during the selection pulse application step and is kept 0 volt during the other steps.

Figure 15:
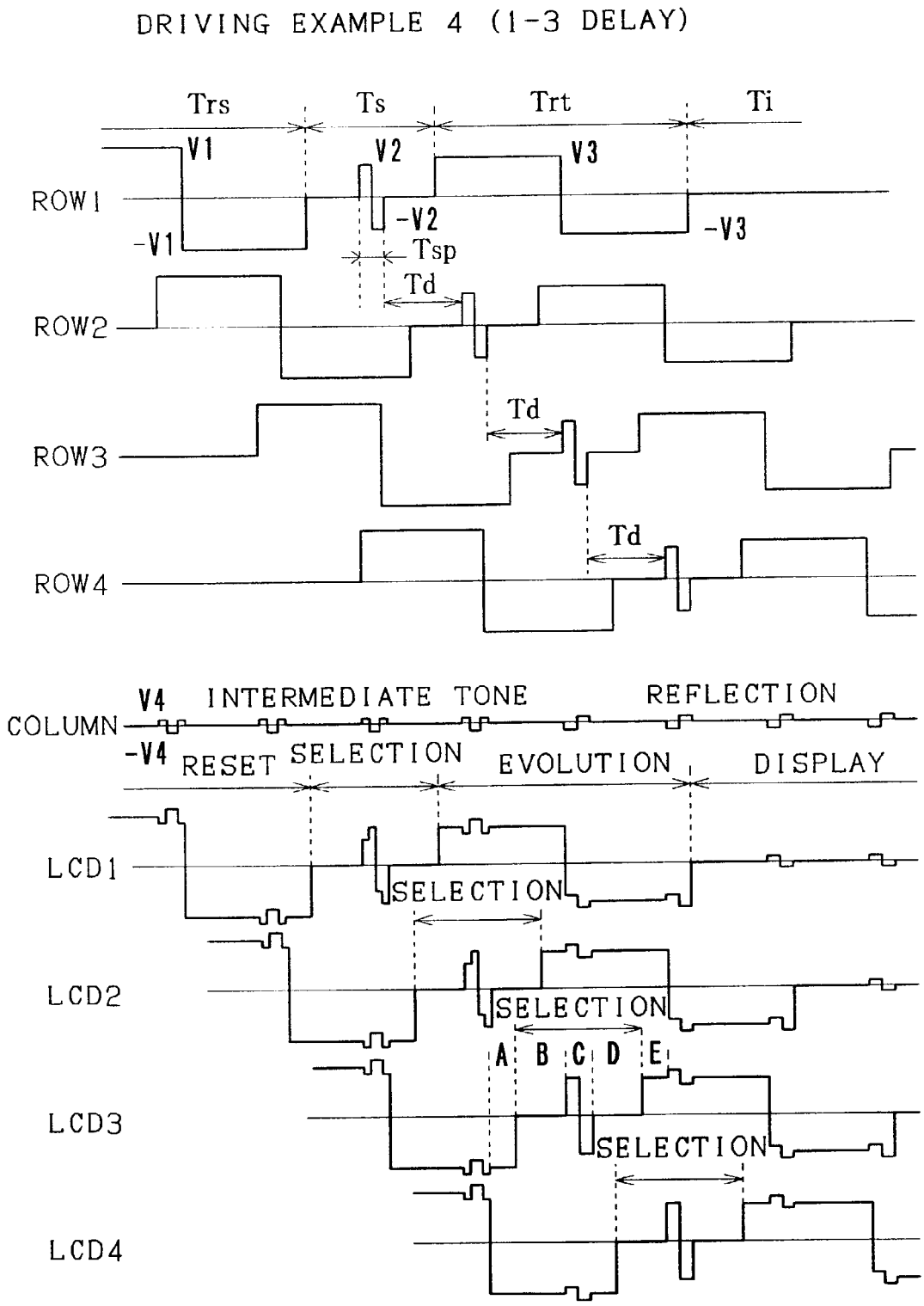
FIG. 15 is a chart which shows driving waves in a fourth driving example which are applied to respective pixels.
Figure 16:
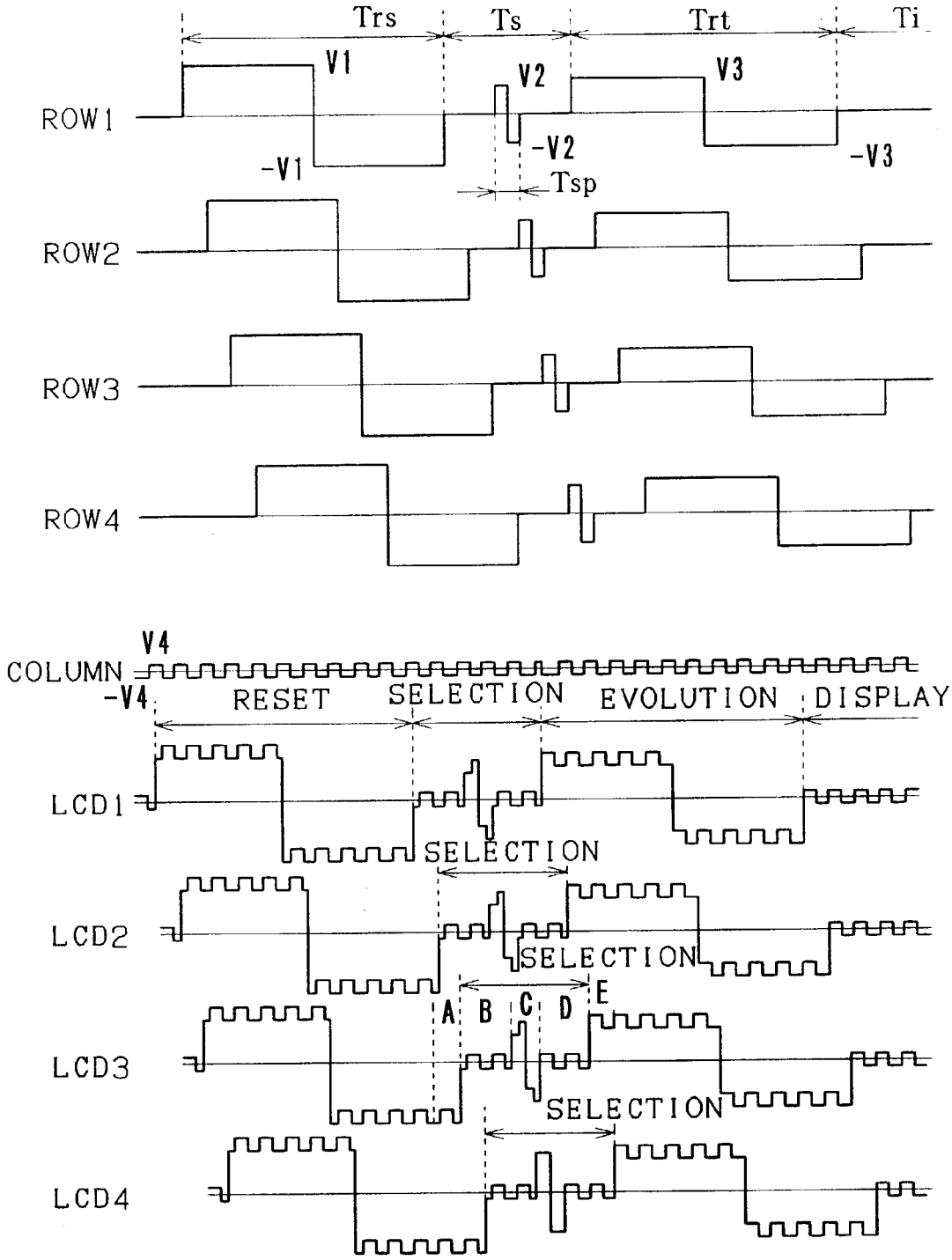
FIG. 16 is a chart which shows driving waves in a second comparative example which are applied to respective pixels.

Like FIG. 13, FIG. 15 shows a case of writing intermediate tones in LCD1 and LCD2 and writing the densest image (reflection) in LCD3 and LCD4. Focusing on the pixel LCD3, in this driving example 4 also, crosstalk does not occur during the steps A, B, D and E.

Like the scanning example 1, the driving example 4 can be combined with the continuous scanning mode. The continuous scanning mode or the delayed scanning mode may be adopted depending on temperature.

FIG. 15 shows a comparative example 2 in which the same driving waves used in the driving example 4 are applied without inserting delays. In the comparative example 2, there are no delay steps, and crosstalk occurs during the steps A, B, D and E.

Prevention of Ghost

In the above-described driving examples 3 and 4 (1-2 delay mode and 1-3 delay mode), a delay step Td is inserted in every scanning line, and the delay step is longer than the pre-selection step and the post-selection step. Therefore, application of crosstalk at least during the pre-selection step B and the post-selection step D can be avoided, and occurrences of ghost can be prevented. If the delay step, the pre-selection step and the post-selection step have respective lengths which are multiples of the length of the selection pulse application step, by setting the length of the delay step to be not less than double the length of the selection pulse application step in accordance with the lengths of the pre-selection step and the post-selection step, as in the examples 3 and 4, crosstalk can be eliminated not only during the pre-selection step B and the post-selection step D but also in the last part of the reset step (duration A) and in the beginning part of the evolution step (duration E). Consequently, occurrences of ghost can be prevented effectively.

However, even in the driving example 1 (2-1 delay mode), in which there are included scanning lines without a delay step, crosstalk during the steps A, B, D and E can be inhibited more or less, and ghost is suppressed compared with the continuous scanning mode. Therefore, if writing speed is important, scanning lines without a delay step may be included within an extent to cause only permissible ghost.

Interlace Scanning

Such delayed scanning modes according to the present invention are adaptable not only to a progressive scanning method in which scanning lines are scanned one by one progressively but also to an interlace scanning method in which one frame is divided into a plurality of fields and scanning lines are scanned with some lines skipped. In carrying out interlace scanning, because the scanning lines which are influenced by crosstalk are scattered within one frame, and ghost shifts largely and is remarkable. Therefore, adoption of the 1-2 delay mode or the 1-3 delay mode in interlace scanning is effective to prevent ghost.

For this reason, it is preferred that sufficiently long delay steps are set in interlace scanning. In other words, for interlace scanning, the 1-2 delay mode is better than the 1-1 delay mode, and further, the 1-3 delay mode is better than the 1-2 delay mode. In a case of producing a liquid crystal display apparatus which can carry out both interlace scanning and progressive scanning and in a case of producing an apparatus in which the number of scanning lines skipped in interlace scanning is variable, the length of delay steps should be designed to be sufficiently long or should be set longer as the number of scanning lines skipped in interlace scanning is larger.

As has been described, when a delay step is inserted in scanning of each scanning line for the purpose of preventing ghost, the time required for renewing the screen is longer. In order to solve this problem, the length of the delay step may be varied field by field, and thereby, the time for renewing the screen can be shortened. For example, as Table 1 shows, various delayed scanning modes are combined field by field. The combinations shown by Table 1 are applicable to any case of dividing a frame into any number of fields. For example, the combination No. 9 is applicable to a case of dividing a frame into two fields and also to a case of dividing a frame into three fields.

TABLE 1

| Combination No. | Combination of Delayed Scanning Modes in Respective Scanning Fields (or Frames) |
|---|---|
| 1 | (1-2) → (1-3) → (1-2) → (1-3) → . . . |
| 2 | (1-2) → (1-3) → (1-4) → (1-2) → (1-3) → (1-4) → . . . |
| 3 | (1-1) → (1-2) → (1-1) → (1-2) → . . . |
| 4 | (1-1) → (1-2) → (1-3) → (1-1) → (1-2) → (1-3) → . . . |
| 5 | (1-3) → (1-3) → (1-2) → (1-3) → (1-3) → (1-2) → . . . |
| 6 | (1-1) → (1-1) → (1-2) → (1-1) → (1-1) → (1-2) → . . . |
| 7 | (1-3) → (1-3) → (1-4) → (1-3) → (1-3) → (1-4) → . . . |
| 8 | (1-2) → (1-2) → (1-1) → (1-2) → (1-2) → (1-1) → . . . |
| 9 | (1-2) → (1-2) → (1-3) → (1-2) → (1-2) → (1-3) → . . . |
| 10 | (1-1) → (1-2) → (1-3) → (1-2) → (1-1) → (1-2) → . . . |
| 11 | (1-2) → (1-3) → (1-4) → (1-3) → (1-2) → (1-3) → . . . |

In carrying out progressive scanning, a plurality of delay modes may be combined in one frame. By adopting different delay modes, for example, by adopting (1-2), (1-3), (1-2), (1-3), . . . to scanning of respective scanning lines, a drive with good balance between power consumption and writing speed is possible. The combinations of delay modes shown in Table 1 may be adopted to scanning of respective scanning lines and may be adopted to scanning of the scanning lines in respective fields.

Structures of Driving ICs; See FIGS. 17 and 18

Figure 17:
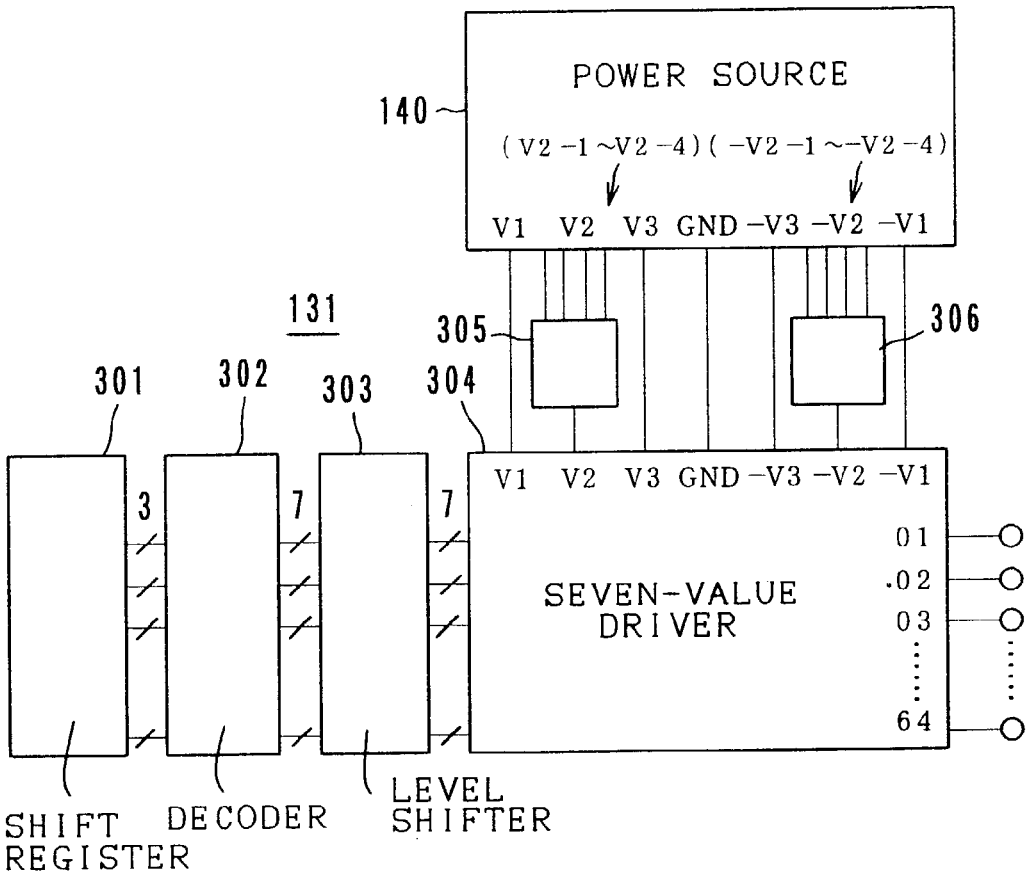
FIG. 17 is a block diagram which shows the structure of a scanning driving IC.

FIG. 17 shows the internal circuit of the scanning electrode driving IC 131 which outputs the basic driving waves in the driving examples 1 through 4 and its power source 140. The scanning electrode driving IC 131 comprises a shift register 301, a decoder 302, a level shifter 303 and a seven-value driver 304.

The power source 140 outputs 12 values of voltages, namely, ±V1, ±V2 (±V2-1, +V2-2, ±V2-3, ±V2-4) and ±V3. The values ±V1 are the reset voltage. The values ±V2 are the selection voltage. Four kinds are possible as the selection voltage, and depending on temperature, the value of the selection voltage is determined. The values ±V3 are the evolution voltage. The reset voltage ±V1 and the evolution voltage V3 are supplied to the driver 304 directly. With respect to the selection voltage ±V2, one of the alternating voltages ±V2-1, ±V2-2, ±V2-3 and ±V2-4 is selected by analog switches 305 and 306, and the selected voltage is supplied to the driver 304.

Three-bit data which indicate seven values of voltages, namely, ±V1, ±V2, ±V3 and GND are inputted to the shift register 301. The data are decoded by the decoder 302, and in accordance with the data, the level shifter 303 selects ±V1, ±V2, ±V3 or GND as an output to each scanning electrode. The driver 304 receives a signal from the level shifter 303 and outputs the selected voltage to each scanning electrode.

Figure 18:
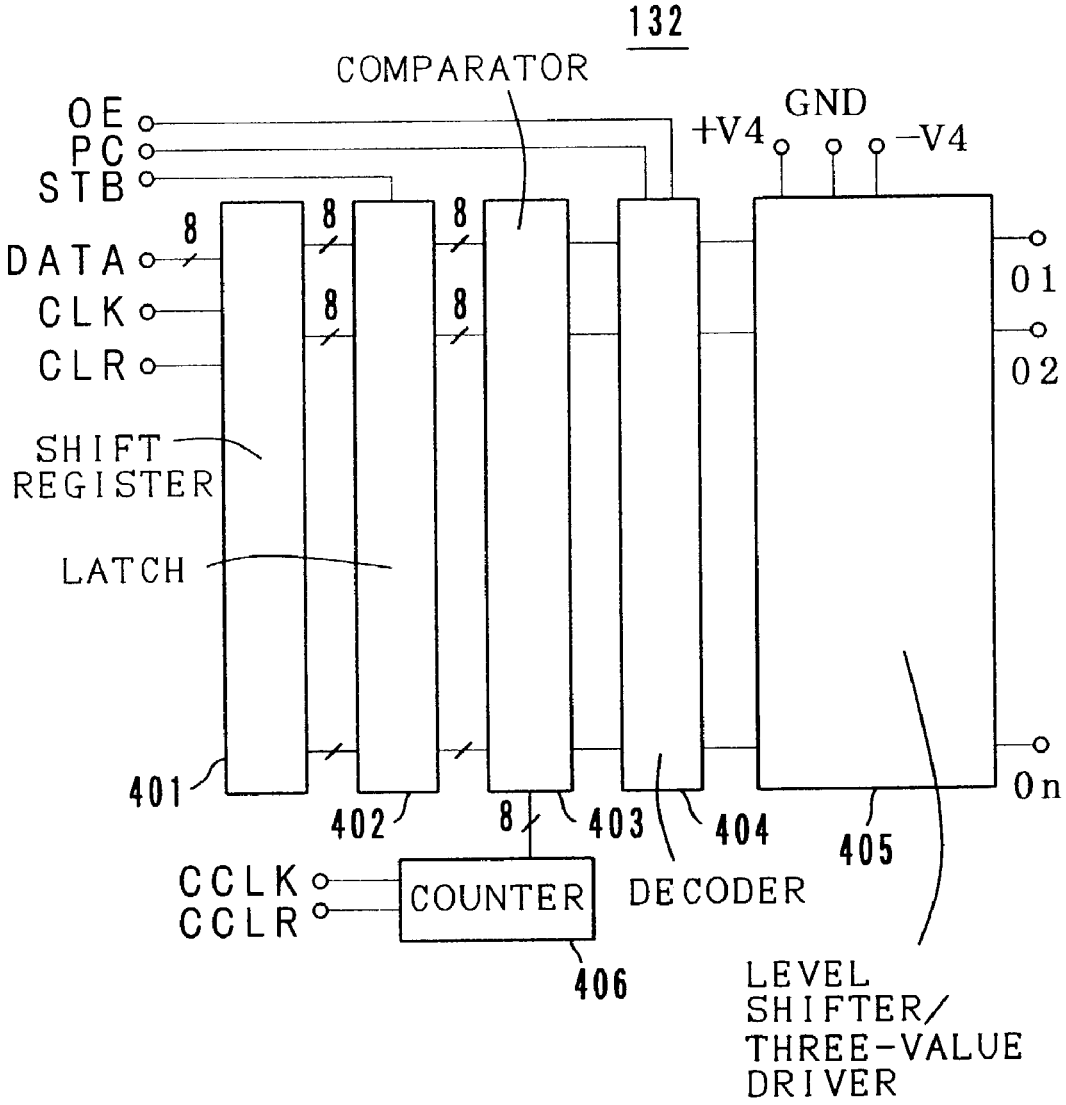
FIG. 18 is a block diagram which shows the structure of a signal driving IC.

FIG. 18 shows an internal circuit of the signal electrode driving IC 132 which outputs a pulse voltage of ±V4. The signal electrode driving IC 132 comprises a shift register 401, a latch 402, a comparator 403, a decoder 404, a level shifter/three-value driver 405 and a counter 406.

In the signal driving IC 132, an output enable signal OE and a polarity conversion signal PC are inputted to the decoder 404. A strobe signal STB is inputted to the latch 404, and an eight-bit data signal DATA, a shift clock signal CLK and a clear signal CLR are inputted to the shift register 401. A clock signal CCLK and a clear signal CCLR are inputted to the counter 406.

The operation of the signal electrode driving IC 132 is described. In response to the shift clock signal CLK, the shift register 401 sets the eight-bit data DATA therein. Next, in response to the strobe signal STB, the data in the shift register 401 is latched in the latch 402. In synchronization with the clock signal CCLK inputted to the counter 406, the eight-bit data in the latch 406 are counted up. At this time, the comparator 403 compares the output from the latch 402 with the output from the counter 406. If the output from the latch 402 is larger, a high-level signal is outputted. If the output from the latch 402 is smaller, a low-level signal is outputted. In response to the output from the comparator, the output enable signal OE and the polarity conversion signal PC, the decoder 404 outputs a signal to drive the level shifter/three-value driver 405.

In order to set the signal pulse voltage to 0V during the delay step Td as in the driving example 1, only during the delay step Td, the output enable signal OE should be set to a high level.

OTHER EMBODIMENTS

The structure, the materials and the producing method of the liquid crystal display may be arbitrarily determined. The liquid crystal display may be of any other structure as well as the RGB three-layered structure and may be a single layer structure. The voltage values, the times and the temperatures used in the pulse waves in the above description are merely examples. In the driving examples 1 and 2, Tsp/Ts are changed intermittently at the borders among some temperature ranges; however, Tsp/Ts may be changed gradually to have a smooth characteristic curve in the entire operating temperature range.

Although the present invention has been described in connection with the preferred embodiments above, it is to be noted that various changes and modifications are possible to those who are skilled in the art. Such changes and modifications are to be understood as being within the scope of the present invention.

What is claimed is:

1. A method for driving a liquid crystal display which comprises liquid crystal which exhibits a cholesteric phase at room temperature, a plurality of scanning electrodes and a plurality of signal electrodes which face and cross each other with the liquid crystal in-between and which makes a display by using selective reflection of the liquid crystal in a cholesteric phase, said method comprising a step of:

applying pulse driving voltages to the liquid crystal by sending data signals in accordance with an image to be displayed to the plurality of signal electrodes while sending a selection signal to the plurality of scanning electrodes in a specified order, wherein:

the driving voltage applying step comprises a reset step of applying reset pulses to reset the liquid crystal to a homeotropic state, a selection step including a selection pulse application step of applying selection pulses to select the final state of the liquid crystal and an evolution step of applying evolution pulses to cause the liquid crystal to evolve to the selected state;

the data signal is variable within a range under a threshold value to change the state of the liquid crystal;

the selection signal comprises a chain of pulses to generate the reset pulses, the selection pulses and the evolution pulses;

the scanning electrodes includes at least one set of scanning electrodes which are to be serially scanned, in scanning of the set of scanning electrodes, a delay step being inserted between the selection pulse application step of a previously scanned scanning electrode and the selection pulse application step of a later scanned scanning electrode;

a length of the selection step and a length of the selection pulse application step are changed in accordance with circumstantial temperature; and a ratio of the length of the selection pulse application step to the length of the selection step is changed in accordance with circumstantial temperature.

2. A method according to claim 1, wherein the data signal during the delay step is 0V.

3. A method according to claim 1, wherein the data signal during the delay step comprises a pulse signal with an absolute value of more than 0V.

4. A method according to claim 1, wherein:

the scanning electrodes include a plurality of sets of scanning electrodes, in scanning of each set of scanning electrodes, a delay step being inserted; and in every delay step, a same driving voltage wave is applied to the liquid crystal.

5. A method according to claim 1, wherein during the delay step, 0V is applied to the liquid crystal.

6. A method according to claim 1, wherein the scanning electrodes include a plurality of sets of scanning electrodes, the scanning electrodes in each step being to be scanned serially and in scanning of each set of scanning electrodes, a delay step being inserted between the selection pulse application step of a previously scanned scanning electrode and the selection pulse application step of a later scanned scanning electrode.

7. A method according to claim 6, wherein a length of the delay step is not less than a length of a pre-selection step between the reset step and the selection pulse application step and is not less than a length of a post-selection step between the selection pulse application step and the evolution step.

8. A method according to claim 1, wherein the length of the delay step is n times the length of the selection pulse application step, wherein n is a positive integer.

9. A method according to claim 1, wherein a length of the delay step is not less than a length of a pre-selection step between the reset step and the selection pulse application step and is not less than a length of a post-selection step between the selection pulse application step and the evolution step.

10. A method according to claim 9, wherein:

the length of the delay step, the length of the pre-selection step and the length of the post-selection step are respectively n times a length of the selection pulse application step, wherein n is a positive integer; and the length of the delay step is a time of two or more units, wherein a time of one unit is the length of the selection pulse application step.

11. A method according to claim 1, wherein:

a delay step is inserted in every specified number of scanning electrodes which are to be serially scanned; and in scanning of two scanning electrodes which are to be serially scanned without a delay step in-between, in synchronization with an end of the selection pulse application step of a previously scanned electrode, the selection pulse application step of a later scanned electrode starts.

12. A method according to claim 1, wherein:

the scanning electrodes include a plurality of sets of scanning electrodes, in scanning of each set of scanning electrodes, a delay step being inserted; and a plurality of kinds of delay steps which have mutually different setting conditions are included in one frame.

13. A method according to claim 1, wherein the order of sending the selective signal to the scanning electrodes is determined so as to permit interlace scanning in which one frame is divided into a plurality of fields and scanning is carried out with some scanning electrodes skipped.

14. A method according to claim 13, wherein the delay steps of the respective fields have mutually different lengths.

15. A method according to claim 13, wherein;

in scanning of each set of scanning electrodes to be serially scanned, a delay step is inserted between the selection pulse application step of a previously scanned scanning electrode and the selection pulse application step of a later scanned scanning electrode; and the delay step has a length which is not less than a length of a pre-selection step between the reset step and the selection pulse application step and is not less than a length of a post-selection step between the selection pulse application step and the evolution step.

16. A method according to claim 1, wherein setting conditions of the delay step is changed in accordance with circumstantial temperature of the liquid crystal display.

17. A method according to claim 16, wherein the setting conditions of the delay step is at least one selected from a group consisting of insertion or omission of the delay step, a length of the delay step and a frequency of the delay step.

18. A method according to claim 1, wherein a ratio of a length of the selection step to a length of the selection pulse application step is changed in accordance with circumstantial temperature of the liquid crystal display.

19. A method according to claim 1, wherein a scanning mode which does not include the delay step and a scanning mode which includes the delay step are combined in accordance with circumstantial temperature range of the liquid crystal display.

20. A method according to claim 1, wherein:

in a first temperature range, the length of the selection step and the length of the selection pulse application step are changed in accordance with circumstantial temperature while the ratio of the length of the selection pulse application step to the length of the selection step is fixed to a first value; and in a second temperature range, the length of the selection step and the length of the selection pulse application step are changed in accordance with circumstantial temperature while the ratio of the length of the selection pulse application step to the length of the selection step is fixed to a second value different from the first value.

21. A liquid crystal display apparatus which comprises a liquid crystal display which comprises liquid crystal which exhibits a cholesteric phase at room temperature, a plurality of scanning electrodes and a plurality of signal electrodes which face and cross each other with the liquid crystal in-between and which makes a display by using selective reflection of the liquid crystal in a cholesteric phase, and a driving circuit for driving the liquid crystal display, wherein:

the driving circuit comprises a scanning electrode driver for sending a selection signal to the plurality of scanning electrodes in a specified order and a signal electrode driver for sending data signals in accordance with an image to be displayed to the plurality of signal electrodes, the driving circuit applying driving voltages to the liquid crystal by sending the data signals to the scanning electrodes from the signal electrode driver while sending the selection signal to the scanning electrodes from the scanning electrode driver, the driving voltage applying step comprises a reset step of applying reset pulses to reset the liquid crystal to a homeotropic state, a selection step including a selection pulse application step of applying selection pulses to select the final state of the liquid crystal and an evolution step of applying evolution pulses to cause the liquid crystal to evolve to the selected state;

the signal electrode driver sends data signals which are variable within a range under a threshold value to change the state of the liquid crystal;

the scanning electrode driver sends a selection signal which comprises a chain of pulses to generate the reset pulses, the selection pulses and the evolution pulses and inserts a delay step between the selection pulse application step of a previously scanned scanning electrode and the selection pulse application step of a later scanned scanning electrode in scanning of at least one set of scanning electrodes which are to be serially scanned;

a length of the selection step and a length of the selection pulse application step are changed in accordance with circumstantial temperature; and a ratio of the length of the selection pulse application step to the length of the selection step is changed in accordance with circumstantial temperature.

22. A liquid crystal display apparatus according to claim 21, further comprising a control circuit for controlling the driving circuit, wherein the control circuit is capable of changing setting conditions of the delay step.

23. A liquid crystal display apparatus according to claim 22, further comprising a temperature sensor for detecting a circumstantial temperature of the liquid crystal display, wherein the control circuit changes the setting conditions of the delay step in accordance with the circumstantial temperature detected by the temperature sensor.

24. A liquid crystal display apparatus according to claim 23, wherein the control circuit is capable of changing reference temperatures at which the setting conditions of the delay step are changed.

25. A method according to claim 20, wherein:

in a first temperature range, the length of the selection step and the length of the selection pulse application step are changed in accordance with circumstantial temperature while the ratio of the length of the selection pulse application step to the length of the selection step is fixed to a first value; and in a second temperature range, the length of the selection step and the length of the selection pulse application step are changed in accordance with circumstantial temperature while the ratio of the length of the selection pulse application step to the length of the selection step is fixed to a second value different from the first value.

26. A device for driving a liquid crystal display which comprises liquid crystal which exhibits a cholesteric phase at room temperature, a plurality of scanning electrodes and a plurality of signal electrodes which face and cross each other with the liquid crystal in-between and which makes a display by using selective reflection of the liquid crystal in a cholesteric phase, said device comprising:

a scanning electrode driver for sending a selection signal to the plurality of scanning electrodes in a specified order; and a signal electrode driver for sending data signals in accordance with an image to be displayed to the plurality of signal electrodes, wherein:

driving voltages are applied to the liquid crystal by sending the data signals to the scanning electrodes from the signal electrode driver while sending the selection signal to the scanning electrodes from the scanning electrode driver;

the driving voltage applying step comprises a reset step of applying reset pulses to reset the liquid crystal to a homeotropic state, a selection step including a selection pulse application step of applying selection pulses to select the final state of the liquid crystal and an evolution step of applying evolution pulses to cause the liquid crystal to evolve to the selected state;

the signal electrode driver sends data signals which are variable within a range under a threshold value to change the state of the liquid crystal;

the scanning electrode driver sends a selection signal which comprises a chain of pulses to generate the reset pulses, the selection pulses and the evolution pulses and insert a delay step between the selection pulse application step of a previously scanned scanning electrode and the selection pulse application step of a lately scanned scanning electrode in scanning of at least one set of scanning electrodes which are to be serially scanned;

a length of the selection step and a length of the selection pulse application step are changed in accordance with circumstantial temperature; and a ratio of the length of the selection pulse application step to the length of the selection step is changed in accordance with circumstantial temperature.

27. A method for driving a liquid crystal display which comprises liquid crystal which exhibits a cholesteric phase at room temperature, a plurality of scanning electrodes and a plurality of signal electrodes which face and cross each other with the liquid crystal in-between and which makes a display by using selective reflection of the liquid crystal in a cholesteric phase, said method comprising a step of:

applying pulse driving voltages to the liquid crystal by sending data signals in accordance with an image to be displayed to the plurality of signal electrodes while sending a selection signal to the plurality of scanning electrodes in a specified order, wherein:

the driving voltage applying step comprises a reset step of applying reset pulses to reset the liquid crystal to a homeotropic state, a selection step including a selection pulse application step of applying selection pulses to select the final state of the liquid crystal and an evolution step of applying evolution pulses to cause the liquid crystal to evolve to the selected state;

the data signal is variable within a range under a threshold value to change the state of the liquid crystal;

the selection signal comprises a chain of pulses to generate the reset pulses, the selection pulses and the evolution pulses;

the scanning electrodes includes at least one set of scanning electrodes which are to be serially scanned, in scanning of the set of scanning electrodes, a delay step being inserted between the selection pulse application step of a previously scanned scanning electrode and the selection pulse application step of a later scanned scanning electrode; and the data signal during the delay step is 0V.

28. A method for driving a liquid crystal display which comprises liquid crystal which exhibits a cholesteric phase at room temperature, a plurality of scanning electrodes and a plurality of signal electrodes which face and cross each other with the liquid crystal in-between and which makes a display by using selective reflection of the liquid crystal in a cholesteric phase, said method comprising a step of:

applying pulse driving voltages to the liquid crystal by sending data signals in accordance with an image to be displayed to the plurality of signal electrodes while sending a selection signal to the plurality of scanning electrodes in a specified order, wherein:

the driving voltage applying step comprises a reset step of applying reset pulses to reset the liquid crystal to a homeotropic state, a selection step including a selection pulse application step of applying selection pulses to select the final state of the liquid crystal and an evolution step of applying evolution pulses to cause the liquid crystal to evolve to the selected state;

the data signal is variable within a range under a threshold value to change the state of the liquid crystal;

the selection signal comprises a chain of pulses to generate the reset pulses, the selection pulses and the evolution pulses;

the scanning electrodes includes at least one set of scanning electrodes which are to be serially scanned, in scanning of the set of scanning electrodes, a delay step being inserted between the selection pulse application step of a previously scanned scanning electrode and the selection pulse application step of a later scanned scanning electrode; and a length of the delay step is not less than a length of a pre-selection step between the reset step and the selection pulse application step and is not less than a length of a post-selection step between the selection pulse application step and the evolution step.

29. A method for driving a liquid crystal display which comprises liquid crystal which exhibits a cholesteric phase at room temperature, a plurality of scanning electrodes and a plurality of signal electrodes which face and cross each other with the liquid crystal in-between and which makes a display by using selective reflection of the liquid crystal in a cholesteric phase, said method comprising a step of:

applying pulse driving voltages to the liquid crystal by sending data signals in accordance with an image to be displayed to the plurality of signal electrodes while sending a selection signal to the plurality of scanning electrodes in a specified order, wherein:

the driving voltage applying step comprises a reset step of applying reset pulses to reset the liquid crystal to a homeotropic state, a selection step including a selection pulse application step of applying selection pulses to select the final state of the liquid crystal and an evolution step of applying evolution pulses to cause the liquid crystal to evolve to the selected state;

the data signal is variable within a range under a threshold value to change the state of the liquid crystal;

the selection signal comprises a chain of pulses to generate the reset pulses, the selection pulses and the evolution pulses;

the scanning electrodes includes at least one set of scanning electrodes which are to be serially scanned, in scanning of the set of scanning electrodes, a delay step being inserted between the selection pulse application step of a previously scanned scanning electrode and the selection pulse application step of a later scanned scanning electrode;

the length of the delay step, the length of the pre-selection step and the length of the post-selection step are respectively n times a length of the selection pulse application step, wherein n is a positive integer; and the length of the delay step is a time of two or more units, wherein a time of one unit is the length of the selection pulse application step.

30. A method for driving a liquid crystal display which comprises liquid crystal which exhibits a cholesteric phase at room temperature, a plurality of scanning electrodes and a plurality of signal electrodes which face and cross each other with the liquid crystal in-between and which makes a display by using selective reflection of the liquid crystal in a cholesteric phase, said method comprising a step of:

applying pulse driving voltages to the liquid crystal by sending data signals in accordance with an image to be displayed to the plurality of signal electrodes while sending a selection signal to the plurality of scanning electrodes in a specified order, wherein:

the driving voltage applying step comprises a reset step of applying reset pulses to reset the liquid crystal to a homeotropic state, a selection step including a selection pulse application step of applying selection pulses to select the final state of the liquid crystal and an evolution step of applying evolution pulses to cause the liquid crystal to evolve to the selected state;

the data signal is variable within a range under a threshold value to change the state of the liquid crystal;

the selection signal comprises a chain of pulses to generate the reset pulses, the selection pulses and the evolution pulses;

the scanning electrodes includes at least one set of scanning electrodes which are to be serially scanned, in scanning of the set of scanning electrodes, a delay step being inserted between the selection pulse application step of a previously scanned scanning electrode and the selection pulse application step of a later scanned scanning electrode;

a delay step is inserted in every specified number of scanning electrodes which are to be serially scanned; and in scanning of two scanning electrodes which are to be serially scanned without a delay step in-between, in synchronization with an end of the selection pulse application step of a previously scanned electrode, the selection pulse application step of a later scanned electrode starts.

* * * * *

UNITED STATES PATENT AND TRADEMARK OFFICE

CERTIFICATE OF CORRECTION

PATENT NO. : 7,038,648 B2
APPLICATION NO. : 10/304887
DATED : May 2, 2006
INVENTOR(S) : Eiji Yamakawa and Naoki Masazumi It is certified that error appears in the above-identified patent and that said Letters Patent is hereby corrected as shown below:

Column 18:
Line 49, delete "claim 20," and insert -- claim 21, --.

Signed and Sealed this

Fifteenth Day of August, 2006

JON W. DUDAS
*Director of the United States Patent and Trademark Office*